US008464672B2

(12) United States Patent
Takemura et al.

(10) Patent No.: US 8,464,672 B2
(45) Date of Patent: Jun. 18, 2013

(54) VARIABLE VALVE TIMING CONTROL APPARATUS FOR INTERNAL COMBUSTION ENGINE

(75) Inventors: Yuichi Takemura, Toyohashi (JP); Minoru Wada, Oobu (JP)

(73) Assignee: DENSO CORPORATION, Kariya (JP)

( * ) Notice: Subject to any disclaimer, the term of this patent is extended or adjusted under 35 U.S.C. 154(b) by 354 days.

(21) Appl. No.: 12/766,007

(22) Filed: Apr. 23, 2010

(65) Prior Publication Data

US 2010/0269772 A1 Oct. 28, 2010

(30) Foreign Application Priority Data

Apr. 23, 2009 (JP) ..... 2009-105725

(51) Int. Cl.
*F01L 1/34* (2006.01)

(52) U.S. Cl.
USPC ..... 123/90.15; 123/90.17

(58) Field of Classification Search
USPC ..... 123/90.15, 90.17
See application file for complete search history.

(56) References Cited

U.S. PATENT DOCUMENTS 5,172,659 A * 12/1992 Butterfield et al. ..... 123/90.17
5,738,056 A 4/1998 Mikame et al.
6,330,870 B1 12/2001 Inoue et al.
7,513,233 B2 * 4/2009 Ichimura et al. ..... 123/90.17
7,987,827 B2 * 8/2011 Fujiyoshi et al. ..... 123/90.17
2005/0034695 A1 * 2/2005 Smith ..... 123/90.17
2006/0236964 A1 * 10/2006 Sawdon et al. ..... 123/90.17
2007/0227482 A1 * 10/2007 Inoue et al. ..... 123/90.17
2008/0022953 A1 * 1/2008 Kanada et al. ..... 123/90.17
2009/0025668 A1 * 1/2009 Matsusaka et al. ..... 123/90.17
2009/0071426 A1 * 3/2009 Knecht et al. ..... 123/90.17
2009/0241878 A1 * 10/2009 Yamaguchi ..... 123/90.17
2010/0251981 A1 * 10/2010 McCloy et al. ..... 123/90.17
2011/0214634 A1 * 9/2011 Yamaguchi et al. ..... 123/90.17

FOREIGN PATENT DOCUMENTS

JP H09-324613 12/1997
JP 2001-159330 6/2001

OTHER PUBLICATIONS

U.S. Appl. No. 12/629,306 of Takemura, filed Dec. 2, 2009.

* cited by examiner

*Primary Examiner* — Thomas Denion
*Assistant Examiner* — Steven D Shipe
(74) *Attorney, Agent, or Firm* — Nixon & Vanderhye PC

(57) ABSTRACT

A variable valve timing control apparatus adjusts the rotation phase (VCT phase) of an engine camshaft by selectively supplying oil to an advancement chamber and a retardation chamber, and includes a lock pin which is controlled for being moveable to a first position, in which the rotation phase is adjustable, and a second position, in which the camshaft is locked at a specific rotation phase. When the lock pin is displaced from the first position, oil becomes enabled to pass between the advancement chamber and retardation chamber, to thereby enabling the rotation phase to be changed to the specific rotation phase by supplying oil to an appropriate one of the advancement chamber and a retardation chamber, for initiating locking.

13 Claims, 11 Drawing Sheets

VARIABLE VALVE TIMING CONTROL APPARATUS FOR INTERNAL COMBUSTION ENGINE

CROSS-REFERENCE TO RELATED APPLICATIONS

This application is based on and incorporates herein by reference Japanese Patent Application No. 2009-105725 filed on Apr. 23, 2009.

BACKGROUND OF THE INVENTION

1. Field of the Invention

The present invention relates to a variable valve timing control apparatus for an internal combustion engine, wherein the control apparatus can implement a locking function for locking the rotation phase of a camshaft of the engine is relative to the crankshaft of the engine, with the rotation phase being locked at approximately the center of its adjustment range.

In the following, the (adjustable) rotation phase of a camshaft relative to the crankshaft of an engine is referred to as the variable cam timing phase, abbreviated to "VCT phase".

2. Description of Related Art

As described for example in Japanese patent first publication No. 9-324613, and Japanese patent first publication No. 2001-159330, it has been proposed to utilize a hydraulic (i.e., operated by oil pressure) type of variable valve timing apparatus in which, when the engine is halted the VCT phase (for example of the camshaft which operates the air intake valves) becomes locked at a phase angle referred to as the intermediate lock phase, which is at approximately the center of the range of adjustment of the VCT phase. This is done to ensure that when the engine is started, the valve timing will be appropriate for the starting operation. Following engine starting, when the oil pressure rises to a sufficient level, the VCT phase is released from the locked condition and thereafter is controlled in accordance with a target value that is determined in accordance with the operating conditions of the engine. In the unlocked condition, the VCT phase may be adjusted by varying respective oil pressures within chambers (an advancement chamber and a retardation chamber) that are located on circumferentially opposite sides of a member (vane) which rotates with the camshaft.

Locking is effected by setting a lock pin in a specific position, e.g., by a spring which urges the lock pin (after the VCT phase has been brought close to the intermediate lock phase) such as to prevent relative rotation between the crankshaft and the camshaft. Lock release is effected by applying oil pressure such as to overcome the force of the spring, so that the lock pin is moved to a position whereby relative rotation between the crankshaft and the camshaft is enabled, so that the VCT phase can be adjusted.

For example, the lock pin may be mounted for sliding motion in a member fixedly attached to the timing sprocket or timing pulley (which is driven from the crankshaft), with a corresponding hole (referred to in the following as the lock hole) being formed in a member fixedly attached to the camshaft, and with respective radial positions of the lock pin and the lock hole being such that the lock pin can be driven to protrude into the lock hole when the VCT phase is close to the intermediate lock phase. Relative rotation between the camshaft and the timing sprocket (or timing pulley) is thereby prevented, so that the VCT phase is locked at the intermediate lock phase.

In general, such a variable valve timing apparatus is operated utilizing engine oil supplied under pressure from the engine oil pump. When the engine is started with the variable valve timing apparatus in the above-described locked condition, the VCT phase is initially set as the intermediate lock phase. Thereafter, as the engine speed increases and the oil pressure increases to a sufficient value (e.g., an "oil lamp activation" engine speed whereby an oil indicator lamp of the vehicle becomes turned on) the locked condition is released. Thereafter, feedback control of the VCT phase is performed, based on a target VCT phase which is determined in accordance with the current running condition of the engine.

During engine idling, when the engine speed is below the oil lamp activation speed so that the oil pressure is low, it is difficult to maintain the VCT phase close to a predetermined value (i.e., which will enable a rapid transition to a higher engine speed, when the idling condition is ended) such as the intermediate lock phase. Hence, it is also usual to utilize the lock pin to lock the VCT phase at the intermediate lock phase during engine idling, in the same manner as when the engine becomes halted.

However with such an apparatus, when the lock pin is actuated to protrude into the lock hole, while oil pressure is being applied for driving the VCT phase to the intermediate lock phase, the tip of the lock pin may become pressed strongly against a side face of the lock hole. This may prevent the lock pin from becoming engaged within the lock hole, or from becoming completely (stably) engaged in the lock hole. Thus the VCT phase may not become securely locked at the intermediate lock phase. When that occurs, a change in the engine running condition may result in the VCT phase becoming inadvertently released from the locked condition, or an excessive load may be imposed on a tip portion of the lock pin, causing deformation of the pin.

Moreover with such an apparatus when oil pressure is applied to drive the lock pin out from the lock hole (for thereby unlocking the VCT phase (o commence feedback control of the VCT phase) the unlocking operation may be unsuccessful. Specifically, the tip of the lock pin may become pressed strongly against a side face of the lock hole, due to the action of feedback control, before the lock pin has been fully withdrawn from the lock hole. The unlocking operation may therefore fail, so that feedback control of the VCT phase cannot be commenced.

To overcome the latter problem, it might be envisaged that the lock release operation could be performed while the target VCT phase is set close to the intermediate lock phase, to thereby prevent the possibility that the tip of the lock pin may become strongly forced against a side face of the lock hole. However, in addition to achieving reliable disengagement of the lock pin, to perform lock release, it is also necessary that the time point at which lock release is achieved can be accurately and reliably detected.

If the lock release operation is performed while the target VCT phase is set close to the intermediate lock phase, then if lock release is successfully achieved, the actual VCT phase will be held close to the intermediate lock phase up until the time point at which lock release occurs, and will remain close to the intermediate lock phase subsequent to that time point. Hence it becomes difficult or impossible to detect the time point at which lock release occurs.

As a result, there will be delays in initiating feedback control for maintaining the VCT phase at a required target value, when the engine speed is to be increased after a period of idling. Thus the responsiveness of the engine, with respect to recovery from the idling condition, will be poor.

Furthermore, control of the VCT phase is not required during the locked condition, so that (i.e., during engine idling) the supplying of oil to fill the advancement angle chamber and retardation angle chamber may be halted during that condition. Alternatively, oil may be supplied to the advancement angle chamber or to the retardation angle chamber at a lowest limit of flow rate, sufficient to maintain the lock pin in a condition of being lightly pressed against a side face of the lock hole, to hold the pin in a steady condition and thereby prevent instability of the VCT phase.

However when the engine temperature is high, the viscosity of the engine oil becomes lowered, so that oil readily leaks through any gaps of the advancement angle chamber and retardation angle chamber. The rate of leakage of the oil between the advancement angle chamber and retardation angle chamber may exceed the rate at which oil is being supplied. In that case, if the locked condition is continued for a long period of time, the amounts of oil within the advancement angle chamber and retardation angle chamber may become excessively low, with the oil pressure in these chambers thereby becoming excessively low. As a result, when a lock release command is issued and the locked condition is then released, the oil pressure within the chambers may be insufficient to maintain the VCT phase, so that the VCT phase may suddenly change in a direction which is opposite to that required for moving to the target VCT phase.

This presents problems, for example by preventing a smooth transition from the idling condition to acceleration of the engine.

To overcome this, it would be possible to continue to supply oil to the advancement angle chamber and retardation angle chamber so long as the locked condition continues. However this may impose an excessive load on the lock pin, lowering its durability. Moreover when the engine is idling, the pressure at which oil is supplied from the oil pump becomes inherently lower. Thus if oil continues to be supplied to the advancement angle chamber and retardation angle chamber in the locked condition, during engine idling, the is pressure of the supply from the oil pump may become excessively low. Specifically, the pressure may become insufficient for driving other hydraulic equipment of the vehicle, so that the operation of such other hydraulic equipment may be adversely affected.

It is an objective of the present invention to overcome the problems described above.

SUMMARY OF THE INVENTION

According to a first aspect, the invention provides a variable valve timing control apparatus comprising a hydraulic type of variable valve timing apparatus, an oil pressure control apparatus for operating the variable valve timing apparatus, and locking control circuitry which controls the oil pressure control apparatus. The variable valve timing apparatus adjusts the valve timing (e.g., of the intake valves) of an internal combustion engine by adjusting the variable cam timing phase (abbreviated herein to VCT phase) of a camshaft of the engine, i.e., to adjust the rotation phase of the camshaft relative to the engine crankshaft. The variable valve timing apparatus includes a lock pin which is movable between a protruding position (in which the VCT phase is held in locked condition at an intermediate lock phase that is within the range of adjustment of the VCT phase) and a retracted position in which the VCT phase is unlocked and so can be adjusted.

The oil pressure control apparatus is controlled to vary a difference between respective oil pressures within an advancement chamber and a retardation chamber of the variable valve timing apparatus, to thereby advance or retard the VCT phase. The lock pin is urged towards the retracted position by supplying oil under pressure to a lock control chamber of the variable valve timing apparatus, and is urged towards the protruding position (e.g., by a spring) when the oil pressure in the lock control chamber is released.

The apparatus is characterized in that, when the lock pin is set in its retracted (lock-release) position, the advancement chamber and retardation chamber are isolated from one another, so that the VCT phase can be adjusted by varying a pressure difference between the advancement chamber and retardation chamber, whereas when the lock pin is displaced by at least a predetermined amount from the retracted position, a passage becomes opened between these chambers allowing oil to flow between them.

The locking control circuitry is configured such that, when locking is to be performed, the oil pressure control apparatus is operated in a lock mode whereby the oil pressure in the lock control chamber is released, causing the lock pin to move to a position in which oil can freely pass between the advancement chamber and retardation chamber. In that condition, oil is supplied to a predetermined one of the advancement chamber and retardation chamber while being exhausted from the other chamber, thereby gradually advancing the VCT phase towards the intermediate lock phase. When the lock control circuitry detects that the VCT phase has ceased to vary (i.e., the extent of variation becomes less than a predetermined amount), it is judged that the locked condition has been reached, with the lock pin securely engaged in the lock hole.

The locking control circuitry is preferably configured to judge that the locked condition has been reached when the VCT phase ceases to vary while in addition the VCT phase is close to the intermediate lock phase.

During operation in the above-described lock mode, since oil can freely pass between the advancement chamber and the retardation chamber, a large pressure difference cannot arise between these chambers. Hence, the VCT phase can be moved to the intermediate lock phase, e.g., due to the varying-amplitude load torque that is applied to the camshaft in actuating the valves. When the VCT phase becomes close to intermediate lock phase, with the lock pin being urged to the predicted position, locking to be achieved.

The VCT phase can thereby be reliably locked at the intermediate lock phase, while the time point at which the VCT phase reaches the locked condition (with the lock pin fully engaged in the lock hole) can be readily detected, with errors in confirming the locked condition being prevented.

The variable valve timing apparatus may incorporate a camshaft spring for applying a torque to the camshaft, acting in the opposite direction to the load torque of the camshaft, i.e., acting in a direction for advancing the VCT phase. In that case, if the locked condition of the VCT phase is to be established at a time when the VCT phase is advanced with respect to the intermediate lock phase, the lock control circuitry controls the oil pressure control apparatus to drive the VCT phase to become retarded with respect to the intermediate lock phase. The lock mode described above is then entered, to move the VCT phase towards the intermediate lock phase, and thereby lock the VCT phase at the intermediate lock phase by engaging the lock pin in the lock hole.

This ensures that the torque applied by the camshaft spring will not prevent the VCT phase from reaching the intermediate lock phase. By first driving the VCT phase to become retarded from the intermediate lock phase, the VCT phase can thereafter be successively advanced (in the lock mode, but without the lock pin yet engaged in the lock hole) until the intermediate lock phase is reached.

The oil pressure control apparatus can comprise two separate hydraulic control valves, i.e., a first valve for supplying oil to the retardation chamber and the advancement chamber and a second valve for controlling locking/unlocking of the VCT phase (i.e., by selectively urging the lock pin towards the retracted position and protruding position through oil pressure control). However the apparatus is preferably configured with a single hydraulic control valve which performs both of these functions.

To enable operation using only a single hydraulic control valve, the oil pressure control apparatus is preferably made operable in a currently selected one of a plurality of operating modes, each corresponding to one of a plurality of respectively separate control regions within a variation range of a control quantity of the hydraulic control valve.

The hydraulic control valve may for example be a type of spool valve in which the spool is displaced by a solenoid actuator which is driven by variable-width pulses. In that case the duty ratio of the drive pulses of the solenoid actuator, referred to herein as the control duty ratio, constitutes the control quantity of the hydraulic control valve.

The operating modes can comprise a retardation mode (in which the VCT phase is driven in a retardation direction), a hold mode (in which VCT phase is held substantially constant), an advancement mode (in which the VCT phase is driven in an advancement direction), and the above-described lock mode (in which the lock pin is urged towards the protruding position, with communication established between the advancement chamber and the retardation chamber via an oil supply passage).

The lock mode is preferably divided into a lock hold mode and an oil fill mode (corresponding to respectively different control regions) such that, during operation in the lock hold mode the advancement chamber and the retardation chamber are held in an isolated condition (connected with one another via the oil supply passage) while during operation in the oil fill mode, oil is supplied to a predetermined one of the advancement chamber and the retardation chamber while being exhausted from the other chamber.

From another aspect the apparatus can comprise phase control circuitry and lock release control circuitry. When the VCT phase is to be released from the locked condition, the lock release control circuitry operates the oil pressure control apparatus such as to drive the lock pin from the protruding position (engaged in the lock hole) to the retracted position. The phase control circuitry determines an appropriate target value of VCT phase, and applies feedback control (using the oil pressure control apparatus) to bring the VCT phase (i.e., actual VCT phase) to the target value. In particular, when lock release of the VCT phase is to be performed, the phase control circuitry determines a target VCT phase which is to be applied in F/B control following the lock release, i.e., a post-release target VCT phase.

To perform lock release, the oil pressure control apparatus applies reverse-direction drive control during a predetermined reverse-direction drive interval. Specifically, oil is supplied to one of the advancement chamber and retardation chamber, selected such as to drive the VCT phase in a direction that is opposite to the direction for moving (from the intermediate lock phase) to the post-release target VCT phase. At the end of the reverse-direction drive interval, the oil pressure control apparatus applies F/B control in accordance with the post-release target VCT phase. Subsequently, lock release is detected as occurring, when the VCT phase begins to vary.

As a result of the above operation, the lock pin first becomes acted on by a laterally-directed force pressing it against a side face of the lock hole, then (when the reverse-direction drive interval ends) the lock pin becomes acted on by a lateral force in the opposite direction. While this is occurring, the lock pin is being urged (by an axially-directed force) towards the retracted (lock release) position. The lock pin can thereby be withdrawn from the lock hole, to achieve lock release, with a high degree of reliability.

From another aspect, the lock control circuitry is preferably configured to control the oil pressure control apparatus while the engine is running with the VCT phase in the locked condition (i.e., during engine idling) such as to establish the above-described oil filling mode (in which oil can freely pass between the advancement chamber and the retardation chamber) during each of periodically repeated short-duration oil fill intervals, for thereby supplying oil to a predetermined one of the advancement chamber and retardation chamber during each of these oil fill intervals. Other than during these short intervals, the lock hold mode is maintained.

In that way, the advancement chamber and the retardation chamber can be held filled with oil during the locked condition with the engine idling, even if leakage of oil from one or both of these chambers occurs during that condition.

Loss of oil pressure within these chambers during the locked condition, due to oil leakage, can thereby be prevented. Thus serves to ensure that a is transition from a condition of engine idling to a higher engine speed can be rapidly and smoothly accomplished, without problems being caused by a momentary insufficiency of oil within the retardation chamber and advancement chamber, resulting from oil leakage.

However since the oil in the advancement chamber and retardation chamber is replenished only during periodic short intervals, it can be ensured that this does not cause a reduction of oil pressure to an extent that the operation of other hydraulic equipment (i.e., which receives oil under pressure from the same oil pump as the variable valve timing control apparatus) will be adversely affected.

The rate at which oil leaks from the advancement chamber and retardation chamber increases in accordance with increased temperature of the oil, and also in accordance with increased oil pressure. For that reason, the duration of each oil fill interval (or the interval between successive oil fill intervals) is preferably adjusted in accordance with the oil temperature (i.e., as measured directly, or as indicated by the engine coolant temperature) and/or the engine running speed (when the oil is supplied to the hydraulic control valve from an engine-driven oil pump).

The above, and other aspects of the invention, may be more clearly understood based on the following description of a preferred embodiment.

DESCRIPTION OF PREFERRED EMBODIMENTS

Figure 1:
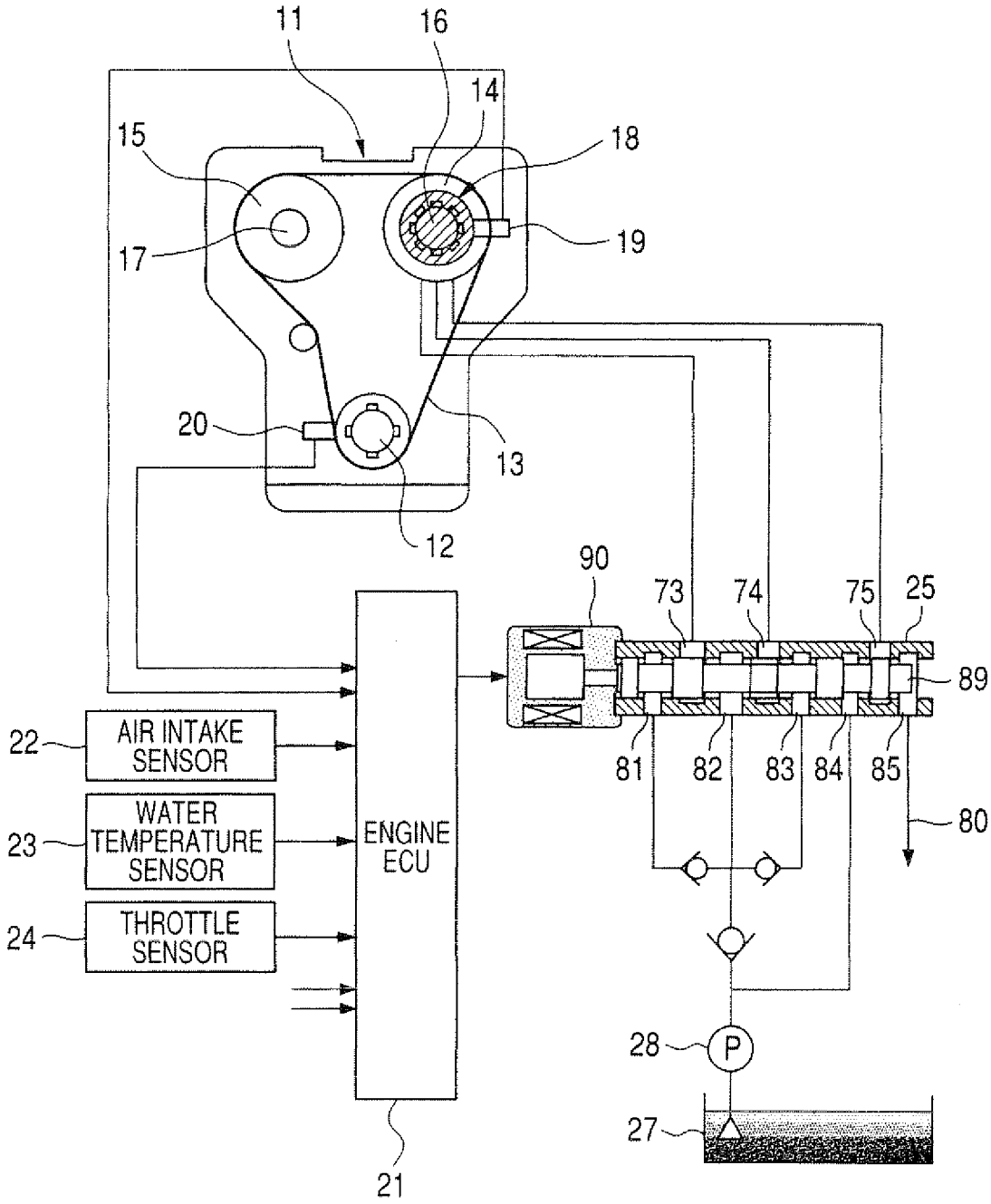
FIG. 1 is a conceptual diagram of the overall configuration of an embodiment of a variable valve timing control apparatus, illustrating the relationship of the control apparatus to an internal combustion engine and a camshaft of the engine.

An embodiment of a variable valve timing control apparatus is described in the following, referring first to FIG. 1. The embodiment is a combination of a variable valve timing apparatus 18, which is a hydraulic drive mechanism that is JO supplied with oil under pressure from an hydraulic control valve 25, and control functions which are implemented by an engine ECU (electronic control unit) 21 for controlling the variable valve timing apparatus 18, by varying the duty ratio of drive pulses supplied to operate a solenoid 90 which actuates the hydraulic control valve 25. Motive force from the crankshaft 12 of an engine 11 is transmitted by a timing chain 13 via sprockets 14 and 15 respectively of an intake camshaft 16 and an exhaust camshaft 17, so that the intake camshaft 16 (camshaft which actuates the air intake valves of the engine 11) rotates in synchronism with the crankshaft 12. The intake camshaft 16 is provided with the variable valve timing apparatus 18, which is controllable for advancing and retarding the rotation phase of the intake camshaft 16 with respect to the crankshaft 12 (i.e., by rotating the crankshaft 12 with respect to the sprocket 14) to thereby correspondingly advance and retard the valve timing of the intake valves. The rotation phase of the intake camshaft 16 relative to the crankshaft 12 is referred to in the following as the VCT (variable cam timing) phase.

A cam angle sensor 19 is mounted close to the peripheral circumference of the intake camshaft 16, for generating cam angle signal pulses in accordance with the intake valve cams of the cylinders of the engine 11 attaining a specific cam angle, i.e., with the cam angle signal pulses corresponding to respective cylinders. A crank angle sensor 20 is mounted close to the periphery of the crankshaft 12, for generating crank angle signal pulses in accordance with the crankshaft 12 attaining a specific crank angle. The output signals from the cam angle sensor 19 and the crank angle sensor 20 are inputted to the engine ECU 21.

Based on timing relationships between the output signals from the cam angle sensor 19 and the crank angle sensor 20, the engine ECU 21 calculates the VCT phase at the current point in time, referred to in the following as the actual VCT phase. The engine ECU 21 also calculates the engine speed (crankshaft rotation speed) based on the frequency of the output pulses from the crank angle sensor 20.

Output signals from various sensors (an air intake sensor 22, a water temperature sensor 23, a throttle sensor 24, etc.) which detect operating conditions of the engine are also inputted to the engine ECU 21.

The engine ECU 21 performs fuel injection control and ignition control of the engine 11 in accordance with the current running condition of the engine 11, as detected by the various sensors. The engine ECU 21 controls the intake valve timing of the engine 11 by feedback control of the actual VCT phase, specifically by selectively supplying oil under pressure to an advancement chamber and retardation chamber of the variable valve timing apparatus 18 as described hereinafter, to bring the actual VCT phase into coincidence with a target VCT phase and thereby set the intake valve timing at a target timing.

Figure 2:
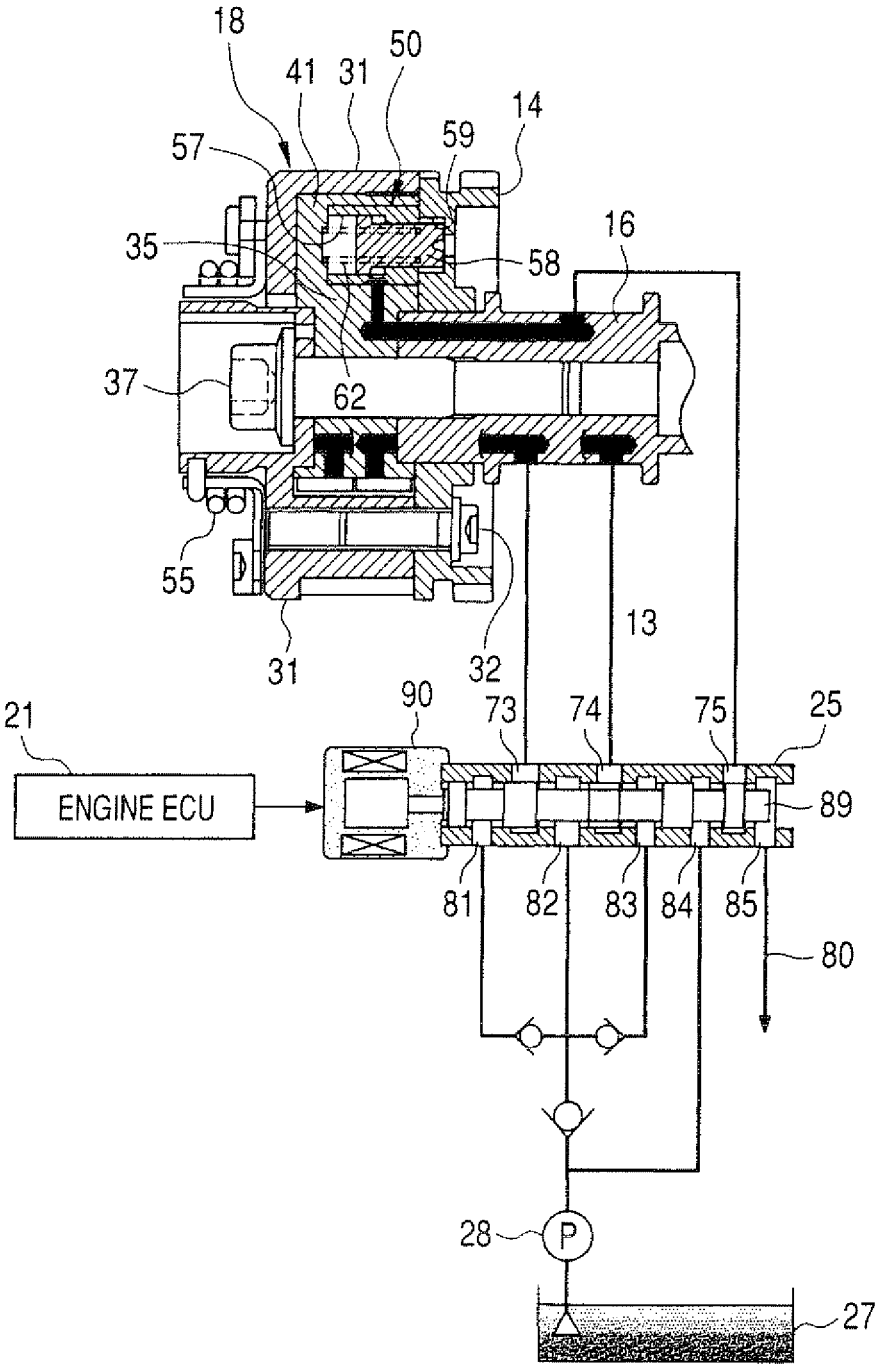
FIG. 2 is a cross-sectional side view of a variable valve timing apparatus of the embodiment, illustrating the relationship of the apparatus to an oil pressure control circuit of an oil pump of the engine.

The configuration of the variable valve timing apparatus 18 will be described referring to FIGS. 2 and 3. The variable valve timing apparatus 18 includes a housing 31 which is screw-attached to the sprocket 14. The sprocket 14 is rotatably supported on the periphery of the intake camshaft 16. The rotation of the crankshaft 12 is transmitted via a timing chain to the sprocket 14 and to the housing 31, so that the sprocket 14 and the housing 31 rotate in synchronism with the crankshaft 12. One end of the intake camshaft 16 is fixedly attached by a bolt 37 to a rotor 35, which is mounted such as to be freely rotatable with respect to the housing 31.

Figure 3:
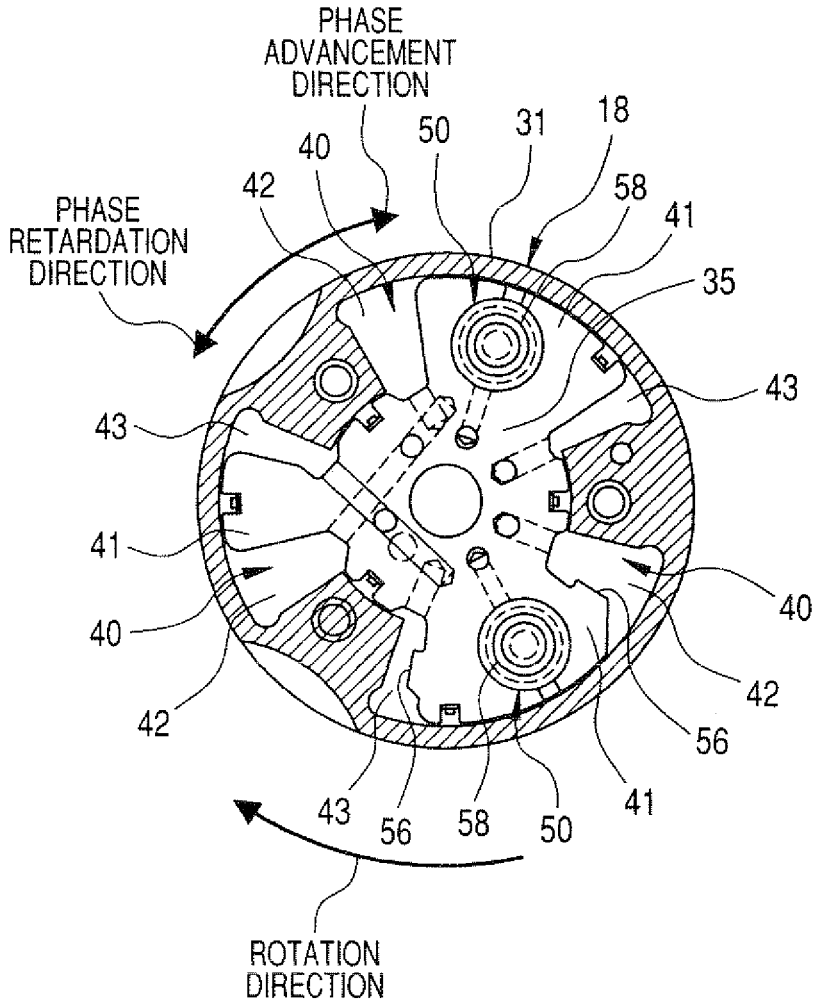
FIG. 3 is a cross-sectional frontal view of the variable valve timing apparatus of the embodiment.

As shown in FIG. 3 the interior of the housing 31 is formed with a plurality of vane accommodation chambers 40. Each vane accommodation chamber 40 is divided into a advancement chamber 42 and a retardation chamber 43 by a vane which is formed circumferentially on the rotor 35. With this embodiment, two vanes 41 are of identical configuration, and each of these is formed for implementing a locking function as described hereinafter, while a third vane 141 is not utilized for the locking function. Stoppers 56 are formed on opposing sides of one vane 41, for limiting the range of rotation of the rotor 35 with respect to the housing 31. Such stoppers are required to be formed on at least one of the vanes. The maximum phase advancement angle and maximum phase retardation angle of the adjustment range of the actual VCT phase are determined by the positions of these stoppers 56.

Each vane 41 is coupled to a corresponding intermediate lock mechanism 50, which can be controlled to lock the actual VCT phase at approximately the center of its range of adjustment as described hereinafter. In the following, only the configuration and operation of a single intermediate lock mechanism 50 and the corresponding one of the vanes 41, will be described. A cylindrical chamber 57, referred to in the following as the lock control chamber is formed in the vane 41 for slidably accommodating a lock pin 58, which can be actuated to lock together the vane 41 (and hence the rotor 35) and the housing 31 for preventing relative rotation between the sprocket 14 and the intake camshaft 16.

Figure 4A:
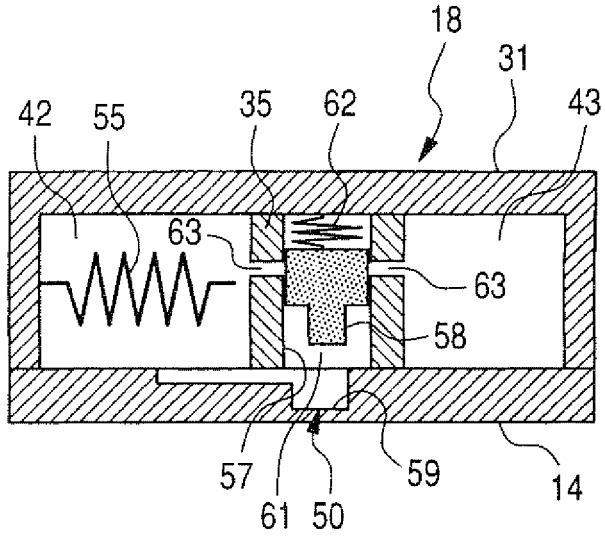
FIGS. 4A, 4B and 4C are conceptual diagrams for illustrating blocking and opening of a passage between an advancement angle chamber and a retardation angle chamber of the variable valve timing apparatus, effected by displacement of a lock pin.
Figure 4B:
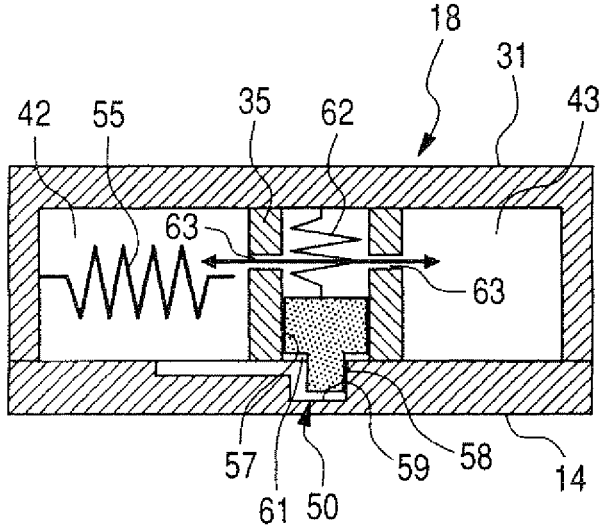
Figure 4C:
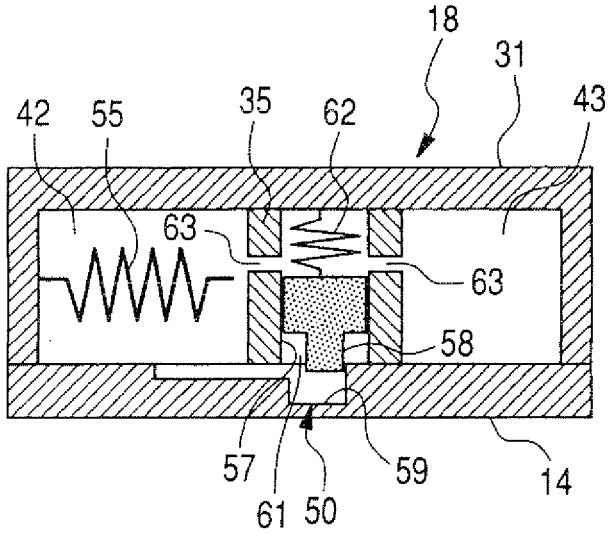

The locked and unlocked conditions of the variable valve timing apparatus 18 are illustrated by the conceptual diagrams of FIGS. 4A to 4C. As shown in FIG. 4A, in the unlocked condition the lock pin 58 is held within lock pin accommodation chamber 57 at a first (retracted) position, by oil pressure, against the urging force exerted by a lock spring 62. Specifically, in the unlocked condition, the engine ECU 21 performs control whereby oil is supplied under pressure to a lock release chamber 61, which is formed between the lock pin 58 and the lock pin accommodation chamber 57 at the axially opposite end of the lock pin 58 from the lock spring 62.

When the locked condition is to be entered, the oil pressure within the lock control chamber 61 released, so that the lock pin 58 becomes urged towards a second (protruding) position in which it will become engaged in a lock hole 59 when the actual VCT phase is brought close to the intermediate lock phase (approximately the center of range of adjustment of the actual VCT phase). When the lock pin 58 has become displaced from the retracted position by more than a predetermined amount (towards the protruding position), oil is enabled to pass between the advancement chamber 42 and retardation chamber 43 via a communicating passage 63.

When the tip of the lock pin 58 becomes fully engaged within the lock hole 59 as illustrated in FIG. 4B, the actual VCT phase becomes locked close to the intermediate lock phase.

The intermediate lock phase corresponds to a valve timing (in this example, intake valve timing) which is suitable at the time of engine starting.

It should be noted that it would be equally possible to configure the variable valve timing apparatus 18 with each lock hole 59 formed in the housing 31.

A camshaft spring 55 (with this embodiment, a coil spring) is attached with respect to the housing 31 and the intake camshaft 16 such as to apply a torque to the intake camshaft 16 in a (angular) direction tending to advance the actual VCT phase, i.e., a torque acting in the opposite direction to the load torque of the intake camshaft 16. Thus when a torque produced by an oil pressure difference between the advancement chamber 42 and retardation chamber 43 acts to advance the actual VCT phase, it is augmented by the torque applied by the camshaft spring 55.

With this embodiment, the range of action of the camshaft spring 55 extends from the condition of the intake camshaft 16 corresponding to maximum retardation of the VCT phase to the condition of the intermediate lock phase. The camshaft spring 55 has the following function during engine starting. When the engine 11 is to be restarted after having stopped abnormally while the variable valve timing apparatus 18 is in the lock-release condition, the lock pin 58 may have been left in a condition of disengagement from the lock hole 59. In that case, if the actual VCT phase is retarded with respect to the intermediate lock phase at the time when the engine stops, then when the engine 11 is cranked by the starter motor (not shown in the drawings) during starting, the urging force of the camshaft spring 55 will cause the actual VCT phase to become advanced, and move to the intermediate lock phase. At this time, the engine speed is insufficient for operating the oil pump 28, so that the urging force of the lock spring 62 will cause the lock pin 58 to be become engaged within the lock hole 59, establishing the locked condition of the actual VCT phase.

In that way, when cranking of the engine is performed by the starter motor, it is ensured that the actual VCT phase will become locked at the intermediate lock phase, thereby setting a suitable intake valve timing during engine starting.

On the other hand, if engine starting is commenced in a condition in which the actual VCT phase is advanced with respect to the intermediate lock phase then during engine cranking, since the load torque of the intake camshaft 16 acts in the retardation direction of the actual VCT phase, the actual VCT phase will become successively retarded by the effect of that load torque. As this continues, the actual VCT phase will reach the intermediate lock phase, enabling the lock pin 58 to become engaged in the lock hole 59. Hence, in this case also, it is ensured that the actual VCT phase will become set at the intermediate lock phase during engine starting.

It should be noted that it would be possible to configure the variable valve timing apparatus 18 such that the spring force exerted by the camshaft spring 55 acts over the entire range of VCT phase values, from maximum retardation phase to maximum advancement.

As illustrated in FIGS. 4A to 4C (again considering a single vane 41) the rotor 35 is formed with a communicating passage 62 which can be opened to provide communication between the advancement chamber 42 and retardation chamber 43, enabling oil to pass between these chambers. As shown in FIG. 4A, when the lock pin 58 is held in the retracted position (withdrawn from the lock hole 59) by oil pressure within the lock control chamber 61, acting against the force exerted by the spring 62, i.e., in the unlocked condition of the VCT phase, the communicating passage 62 is closed by the lock pin 58, isolating the advancement chamber 42 from the retardation chamber 43.

As shown in FIG. 4B, when the oil pressure within the lock control chamber 61 is reduced, causing the lock pin 58 to be moved by the lock spring 62 to a protruding position in which the tip of the lock pin 58 is engaged within the lock hole 59 (locked condition of the VCT phase) the communicating passage 62 is open, so that oil can pass between the advancement chamber 42 and the retardation chamber 43. Specifically, when the lock pin 58 has become moved by more than a predetermined amount from the retracted position (i.e., even before becoming engaged within the lock hole 59) the communicating passage 62 becomes opened, enabling oil to pass between the advancement chamber 42 and the retardation chamber 43. With this embodiment, the hydraulic control valve 25 serves two separate functions. Firstly, it serves as an oil pressure valve for controlling the pressure at which oil is supplied to the advancement chamber 42 and retardation chamber 43 (for adjusting the actual VCT phase). Secondly, the hydraulic control valve 25 functions as an oil pressure valve for controlling locking and unlocking of the VCT phase, by controlling oil pressure within the lock release chamber 61 to drive the lock pin 58 to the protruding position or retracted position as described above.

Oil from the engine oil pan 27 is supplied under pressure by an oil pump 28 (driven by the engine 11) to input ports 81 to 84 of the hydraulic control valve 25.

The hydraulic control valve 25 of this embodiment is an 8-port 5-position spool valve, which is operated by linear displacement of a spool 89. This displacement is effected by the solenoid 90, under the control of the engine ECU 21. Output ports of the hydraulic control valve 25 are connected via flow lines to respective chambers of the variable valve timing apparatus. An output port 73 of the hydraulic control valve 25 (designated in the following as the advancement port) is connected to the advancement chamber 42. Similarly, an output port 74 of the hydraulic control valve 25 (designated in the following as the retardation port) is connected to the advancement chamber 42. An output port 75 of the hydraulic control valve 25 (designated in the following as the lock release port) is connected to the lock control chamber 61. via a flow line 72 and a corresponding passage within the intake camshaft 16.

The hydraulic control valve 25 is controlled by the engine ECU 21 to supply and exhaust oil to/from each of advancement port 73, the retardation port 74 and the lock release port 75 via a corresponding oil supply passage. Specifically, the engine ECU 21 controls the solenoid 90 for axially sliding the spool 89 of the hydraulic control valve 25 to selected positions within a maximum range of displacement. The currently selected position of the spool 89 determines, for each of the output ports, whether the oil supply passage corresponding to that port is open or closed, or the output port is connected to the drain port 85 (for removing oil from the corresponding chamber).

Figure 5A:
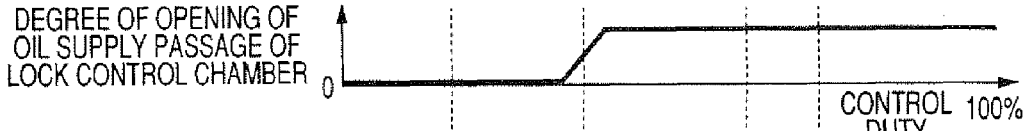
FIGS. 5A to 5D are diagrams illustrating control characteristics of the variable valve timing apparatus.
Figure 5B:
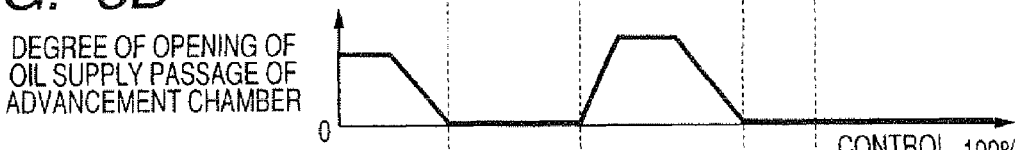
Figure 5C:
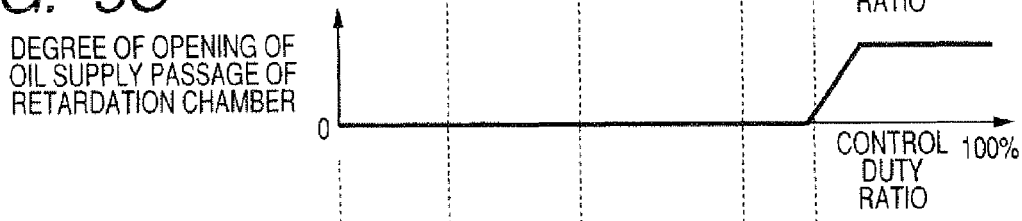
Figure 5C:
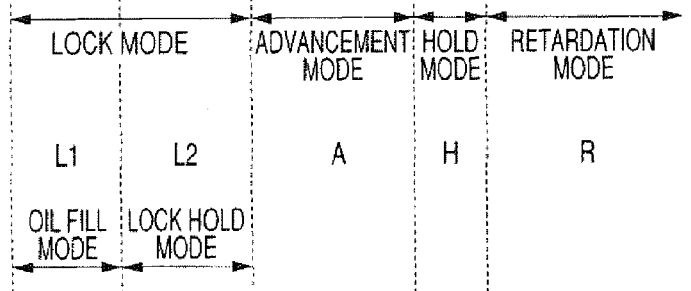

The aforementioned duty ratio of the drive pulses supplied by the engine ECU 21 to operate the solenoid 90 (for determining the extent of displacement of the spool 89 of the hydraulic control valve 25) is referred to in the following as the control duty ratio. The relationships between respectively separate regions within the range of the control duty ratio (referred to in the following as control regions) and combinations of open/closed condition of the respective oil supply passages of the advancement port 73, retardation port 74 and lock release port 75 are illustrated graphically in FIGS. 5A, 5B and 5C. FIG. 5A shows the relationship between respective control regions and the extent of opening of the oil supply passage of the lock control chamber 61 (i.e., of the lock release port 75). FIG. 5B shows the corresponding relationship with respect to the oil supply passage of the advancement chamber 42, and FIG. 5C shows the corresponding relationship with respect to the oil supply passage of the retardation chamber 43.

As shown, five separate control regions correspond to respective modes, designated as an oil fill mode L1, a lock hold mode L2 an advancement angle mode A, a holding mode H, and a retardation angle mode R. The modes L1 and L2 are referred to collectively as the lock mode.

Figure 5D:
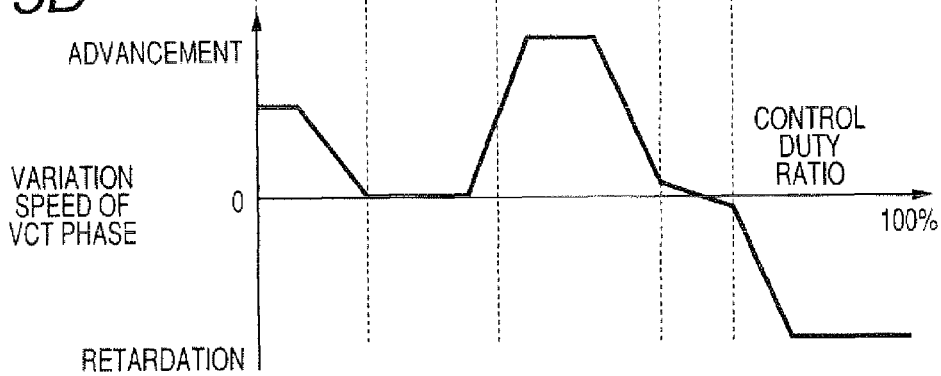

FIG. 5D illustrates the manner in which the rate of variation of the actual VCT phase changes, within the range of adjustment of the control duty ratio.

In each of the control regions of the lock modes L1 and L2 (again considering only a single vane 41) the oil supply passage of the lock control chamber 61 (i.e., of the lock release port 75) is closed, and the lock release port is 75 is opened to the drain port 85. The oil pressure within the lock control chamber 61 is thereby released, and the lock pin 58 is urged towards the protruded position by the action of the spring 62.

In that condition, as described above, oil can pass between the advancement chamber 42 and retardation chamber 43 via the communicating passage 63. Furthermore in the control region of the lock mode L1 the oil supply passage of the advancement chamber 42 (i.e., of the advancement port 73) is open, while the retardation chamber 43 is connected to the drain port 85. In the control region of the lock mode L2, the oil supply passages of the advancement chamber 42 and retardation chamber 43 are both closed, so that the oil pressure within these is held unchanged, but the communicating passage 63 remains open.

In each of the advancement mode A, hold mode H and retardation mode R, the oil supply passage of the lock control chamber 61 is open, so that the lock pin 58 is held in the retracted position by oil pressure, and transfer of oil between the retardation chamber 43 and advancement chamber 42 via the communicating passage 63 is blocked.

In the control region of the advancement mode A, the retardation chamber 43 is connected to the drain port 85, while the oil supply passage of the advancement chamber 42 is open. The VCT phase is thereby advanced.

In the holding mode H, the respective oil supply passages of the advancement chamber 42 and the retardation chamber 43 are closed, thereby holding the oil pressure within each of the advancement chamber 42 and retardation chamber 43 unchanged, and so holding the actual VCT phase unchanged. More specifically, the hydraulic control valve 25 is configured such that at some specific value of control duty ratio (referred to in the following as the hold value, indicated in FIG. 5*a* as the central value in the range of the hold mode H), the oil pressure within each of the advancement chamber 42 and retardation chamber 43 is held unchanged, while any increase or decrease of the control duty ratio from the hold value will result in a corresponding amount of retardation or advancement of the actual VCT phase, respectively. The hold value is preferably determined beforehand by a learning procedure.

In the control region of the retardation mode R, the advancement chamber 42 becomes connected to the drain port 85 and the oil supply passage of the retardation chamber 43 is opened, resulting in retardation of the VCT phase.

As can be understood from the above, in each mode other than the lock modes L1 and L2, oil pressure is maintained within the lock control chamber 61 for retaining the lock pin 58 disengaged from the lock hole 59 while isolating the retardation chamber 43 from the advancement chamber 42.

This embodiment is configured such that as the control duty ratio of the hydraulic control valve 25 is successively increased, the control modes are respectively selected in the sequence: lock mode L1, lock mode L2, advancement mode A, holding mode H, retardation mode R. However it would be equally possible to configure the apparatus such that that as the control duty ratio is successively increased, the control modes are selected in the sequence: retardation mode R, holding mode H, advancement mode A, lock mode L1, lock mode L2.

As a further alternative, it would be possible to reverse the sequence positions of the retardation mode R and advancement mode A from those of the embodiment, i.e., so that as the control duty ratio is successively increased, the control modes are selected in the sequence: lock mode L1, lock mode L2, retardation mode R, holding mode H, advancement mode A.

Furthermore it should be noted that the invention is not limited to the use of a single hydraulic control valve 25 in common to perform the function of an hydraulic control valve used for adjusting the actual VCT phase and also the function of an hydraulic control valve used for locking the VCT phase. It would be equally possible to use separate hydraulic control valves for these functions.

The engine ECU 21 corresponds to phase control circuitry, as recited in the appended claims. The engine ECU 21 performs processing for calculating a target VCT phase required phase based upon the current operating condition of the engine 11, with the target VCT phase being applied in feedback control of the actual VCT phase. Other than when operating in the lock modes L1 or L2, the engine ECU 21 executes feedback control (abbreviated in the following to FIB control) of the control duty ratio of the hydraulic control valve 25 for maintaining the actual VCT phase (as detected based on the output signals from the crank angle sensor 20 and cam angle sensor 19) close to the VCT phase, i.e., with the control duty ratio being the controlled quantity of the FIB control.

In addition, the engine ECU 21 implements the function of lock control circuitry as recited in the appended claims. Specifically, the engine ECU 21 performs lock control of the hydraulic control valve 25 whereby when a lock command is issued, the actual VCT phase becomes shifted to the intermediate lock phase and in that condition, enabling the lock pin 58 (in the protruded condition, urged by the lock spring 62) to become engaged in the lock hole 59.

Figures 6A, 6B, 6C:
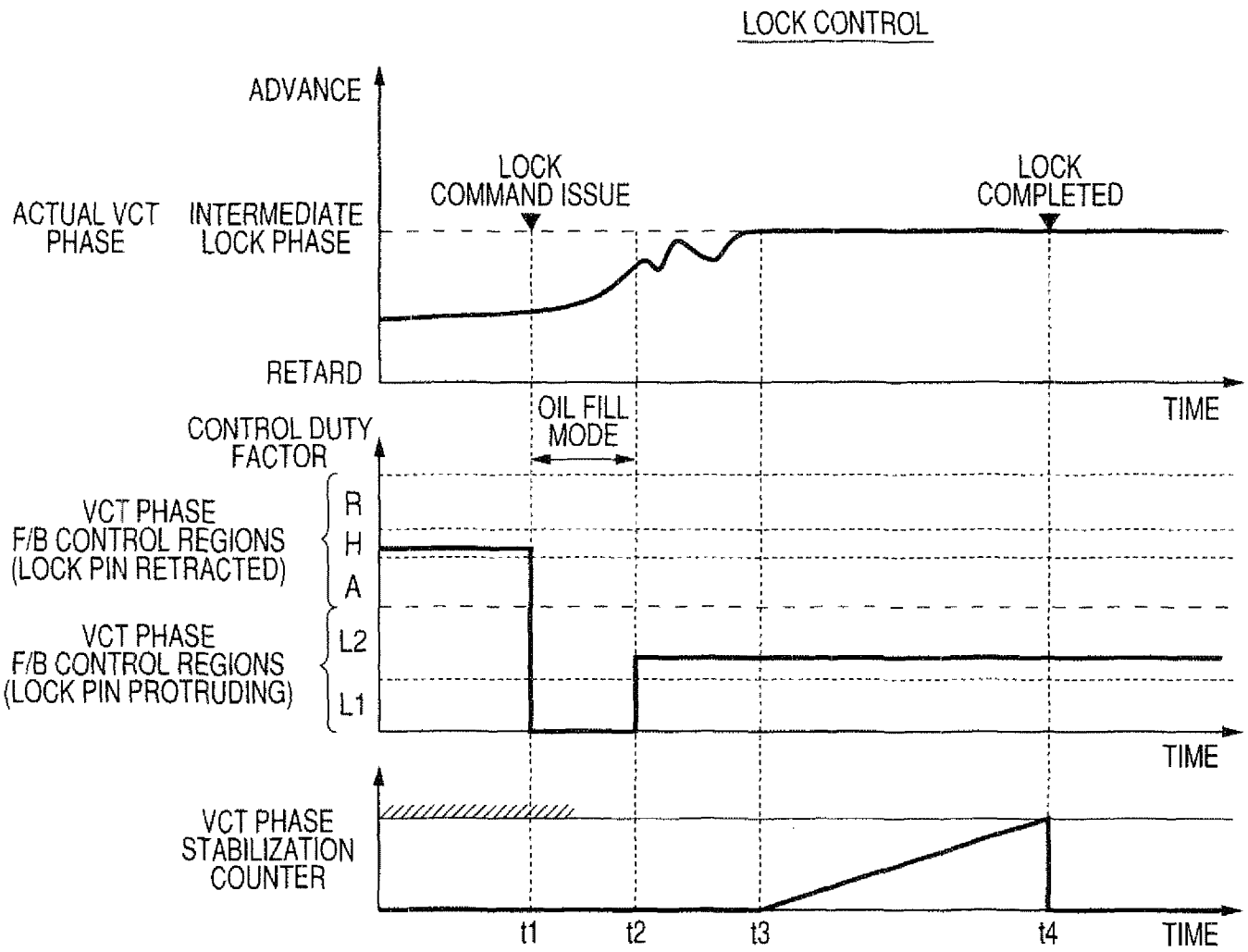
FIGS. 6A to 6C are timing diagrams for illustrating an example of lock control applied for establishing a locked condition of the variable valve timing apparatus.

FIGS. 6A to 6C are timing diagrams illustrating an example of applying lock control. FIG. 6A shows the time-axis variation of the actual VCT phase, FIG. 6B shows the time-axis variation of the control duty ratio, and FIG. 6C shows the time-axis variation of the count of a VCT phase stabilization counter.

In this example, it is assumed that when a lock command is issued at a time point t1, the actual VCT phase is retarded with respect to the intermediate lock phase to a suitable extent for commencing to apply lock control, and the control duty ratio is in the range of the holding mode H. As described hereinafter referring to FIG. 10, if the actual VCT phase is not in that appropriate phase-retarded condition when the lock command is issued, FIB control is first performed such as to bring the actual VCT phase to the initial condition illustrated in FIG. 6A.

In response to the lock command, the engine ECU 21 sets the control duty ratio within the range of the lock mode L1 (oil filling mode), e.g., at 0%. The lock pin 58 thereby becomes protruded towards the sprocket 14, but is not yet engaged within the lock hole 59. However in that condition, the lock pin 58 is protruded to a sufficient extent that that the communicating passage 63 becomes opened, allowing oil to pass between the advancement chamber 42 and retardation chamber 43. At the same time, oil is supplied by the hydraulic control valve 25 to the advancement chamber 42 while the retardation chamber 43 becomes connected to the drain port 85. Thus, part of the oil supplied to the advancement chamber 42 passes through the communicating passage 63 to the retardation chamber 43.

Due to the flow resistance of the communicating passage 63, the oil pressure within the advancement chamber 42 becomes somewhat higher than that within the retardation chamber 43, i.e., there is a delay between an increase in pressure within the advancement chamber 42 and a resultant pressure increase within the retardation chamber 43. Due to this pressure difference, a torque is applied to the vane 41 causing the actual VCT phase becomes gradually advanced after the time point t1, as shown in FIG. 6A, and so approach the intermediate lock phase.

At this time the camshaft spring 55 is applying torque in a direction for advancing the actual VCT phase, thereby augmenting the effect of the pressure difference between the advancement chamber 42 and retardation chamber 43 in bringing the actual VCT phase towards the intermediate lock phase.

When it is judged (at time point t2) that the actual VCT phase has been brought sufficiently close to the intermediate lock phase (i.e., it is detected that the difference between the actual VCT phase and the intermediate lock phase has become less than a predetermined amount), the control duty ratio is shifted to within the range of the lock mode L2. In the lock mode L2 the lock pin 58 continues to be urged by the lock spring 62 towards the protruding position. Also in this mode the respective oil supply passages of the advancement chamber 42 and the retardation chamber 43 are held closed (or permit only a is small rate of flow of oil to these chambers), so that the oil pressure within each of the advancement chamber 42 and the retardation chamber 43 is held constant.

In this condition following time point t2, since oil can pass freely between the advancement chamber 42 and retardation chamber 43, the actual VCT phase continues to be gradually advanced due to the torque applied by the camshaft spring 55, while at the same time the actual VCT phase is fluctuating due to the varying load torque which is being applied to the intake camshaft 16, as illustrated in FIG. 6A.

As a result the lock pin 58 reaches the of the lock hole 59 at a time point t3, with the actual VCT phase close to the intermediate lock phase, and the tip portion of the lock pin 58 then engages in the lock hole 59, so that the locked condition is established.

If the lock pin 58 becomes stably engaged in the lock hole 59, the actual VCT phase will become fixed, close to the intermediate lock phase. Hence, following time point t2 the engine ECU 21 monitors the actual VCT phase to determine if it remains substantially fixed at the intermediate lock phase, based on the count of a VCT phase stabilization counter as described hereinafter. If it is detected that the actual VCT phase remains stabilized (e.g., variation is less than a predetermined extent during the interval between time points t3 and t4 in FIG. 6C) the engine ECU 21 judges that locking has been completed.

In such a stabilized condition, the lock pin 58 is fully engaged in the lock hole 59, as illustrated in FIG. 4B.

Figures 7A, 7B, 7C:
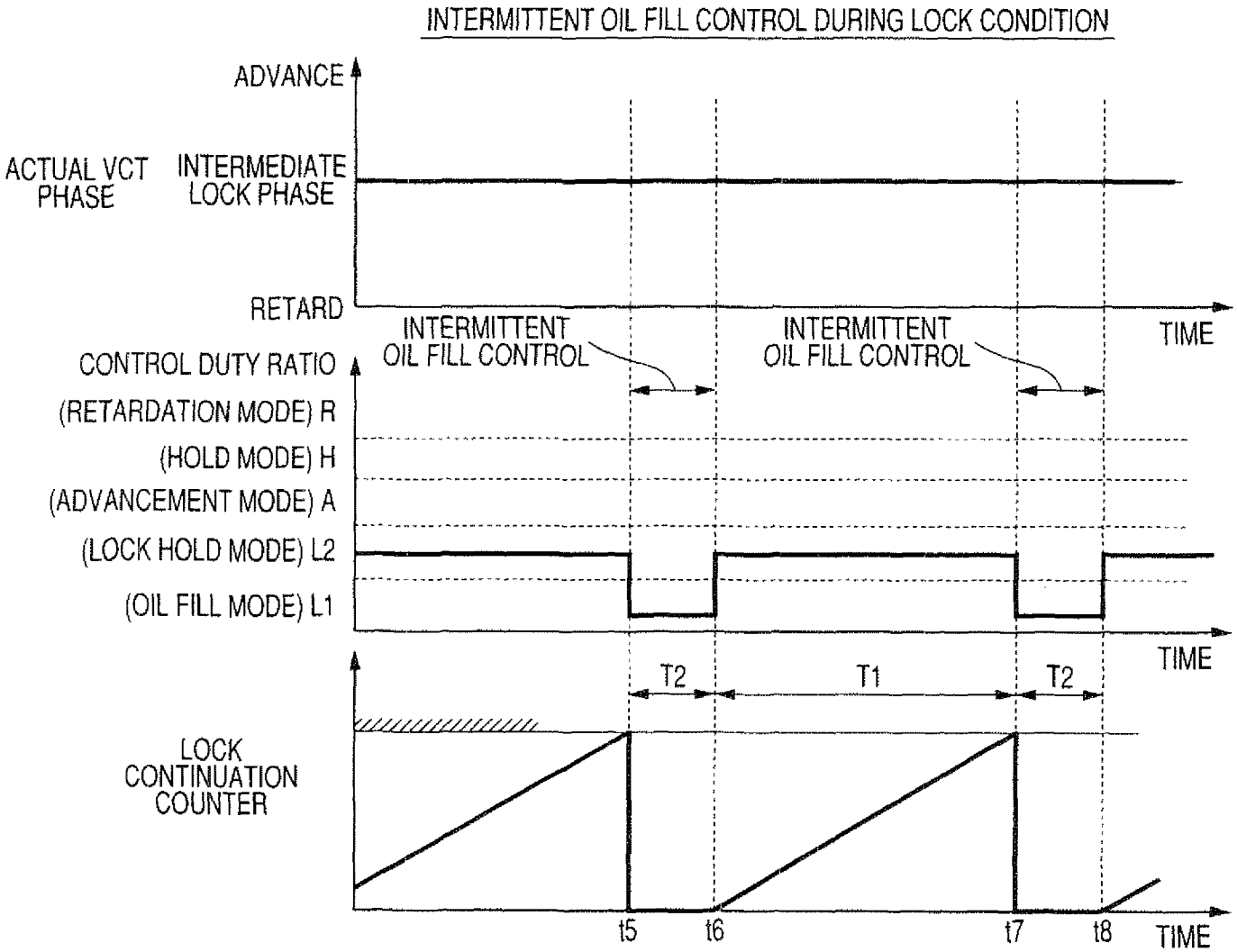
FIG. 7A to 7C are timing diagrams for use in describing intermittent oil filling control that is executed by the embodiment during the locked condition.

FIG. 7A to 7C are timing diagrams which illustrate intermittent oil filling control that is executed by the engine ECU 21 for the duration of the locked to condition (when the engine 11 is idling). FIG. 7A shows the time-axis variation of the actual VCT phase, FIG. 7B shows the corresponding variation of the control duty ratio, and FIG. 7C shows the corresponding variation of the count of a lock continuation interval counter.

As shown in FIG. 7B, each time a predetermined interval T1 has elapsed (as measured by the lock continuation counter) the control duty ratio is shifted from the range of the lock mode 2 (lock hold mode) to that of the lock mode 1 (oil fill mode). Oil is thereby supplied to the advancement chamber 42 and hence via the communicating passage 63 to the retardation chamber 43, as described hereinabove. However in this case, since the vane 41 is held locked by the lock pin 58, the VCT phase is not altered by the supplying of oil to the advancement chamber 42.

This is continued for a short-duration fixed interval T2 (as measured by an intermittent oil fill control execution interval counter), then the lock mode 2 is restored. In that way, replenishment of the oil in the advancement chamber 42 and retardation chamber 43 is performed only during periodic short intervals. It is thereby ensured that if leakage of oil from the advancement chamber 42 and retardation chamber 43 occurs while the apparatus remains in the locked condition (in the lock mode 2), the leakage amounts are replenished during each of the periodic oil fill intervals (T2).

Thus even if some leakage of oil from the advancement chamber 42 and retardation chamber 43 occurs, the intermittent oil filling control ensures that such leakage will not result in significant reduction of the amounts of oil in these chambers, so that lowering of the oil pressure within them due to leakage is prevented. This ensures that rapid changeover can be achieved from the locked condition of the actual VCT phase (during engine idling) to FIB control of the actual VCT phase, without problems being caused by a momentary insufficiency of oil pressure within the advancement chamber 42 and retardation chamber 43 at the time of changeover.

However since the intermittent oil filling control is executed only periodically for short intervals, it is ensured that sufficient oil pressure remains available for driving other hydraulic-drive equipment of the vehicle, so that there is no adverse effect upon the operation of such other equipment.

The duration T1 of the interval between successive intervals (T2) of intermittent oil filling control may be determined based on the maximum anticipated rate of oil leakage from the advancement chamber 42 and retardation chamber 43. However the rate of leakage varies in accordance with the oil temperature, which may be measured directly or estimated based on the engine coolant temperature. In addition the rate of leakage varies in accordance with oil pressure, and so with the engine speed. Hence it is preferable to adjust the interval duration T1 in accordance with at least one of a set of parameter values, i.e., the oil temperature, the engine coolant temperature, and the running speed of the engine 11.

The oil pressure within the advancement chamber 42 and retardation chamber 43 can thereby be maintained sufficiently during engine idling in the locked condition of the variable valve timing apparatus 18, by periodically replenishing the leakage amounts in successive short-duration intervals.

The engine ECU 21 of this embodiment also corresponds to lock release control circuitry as recited in the appended claims, which performs control for driving the lock pin 58 in a direction for achieving lock release when a lock release command is issued. With the embodiment, lock release control consists of control for disengaging the lock pin 58 from the lock hole 59, i.e., moving the lock pin 58 to the retracted position and also thereby closing the communicating passage 63.

Figures 8A, 8B:
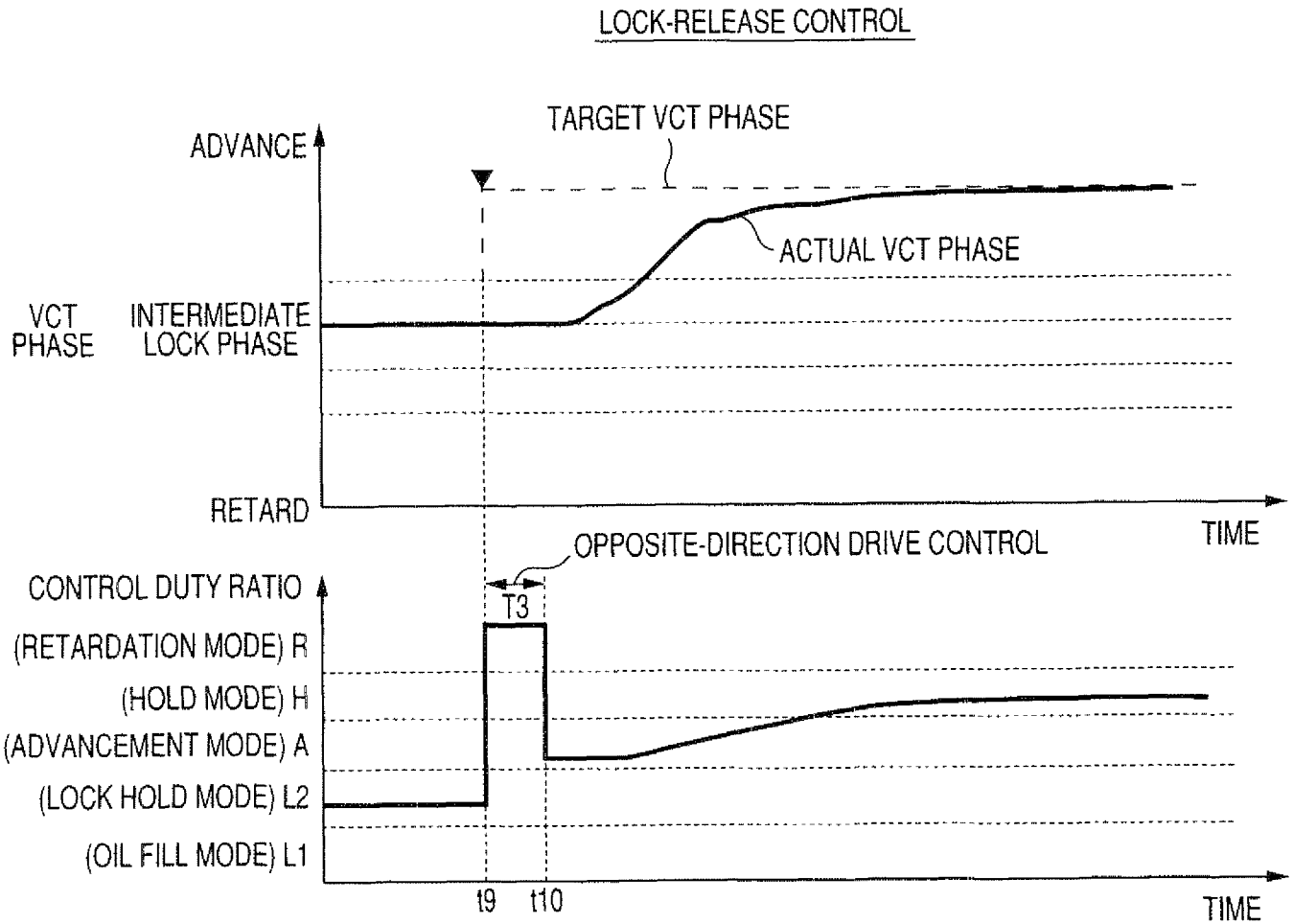
FIGS. 8A and 8B are timings diagram for use in describing lock release control that is executed by the embodiment for ending the locked condition.

FIGS. 8A and 8B are timing diagrams which illustrate the lock release control performed with this embodiment. FIG. 8A shows an example of time-axis variation of the actual VCT phase when lock release control is applied. FIG. 8B illustrates corresponding variation of the control duty ratio during lock release control.

In this example, the apparatus is initially operating in lock mode 2 (lock holding mode), with the actual VCT phase thereby fixed close to the intermediate lock phase. It is assumed that the 21× determines that, after lock release is achieved, FIB control is to be applied based on a target VCT phase (referred to in the following as the post-release target VCT phase) which is is advanced with respect to the intermediate lock phase. Hence, when a lock release command is issued at time point t9, the control duty ratio is set within the range of the retardation mode R.

This is one of the modes (retardation mode R, holding mode H and advancement mode A) in which the oil supply passage of the lock control chamber 61 is open, so that oil pressure applies a force urging the lock pin 58 towards the lock retracted (unlocked) position.

Following time point t9, during a short interval T3 (designated herein as an opposite-direction drive control interval), this condition is continued, with the rotor 35 being urged in the phase retardation direction illustrated in FIG. 3, i.e., the opposite direction to that required for driving the actual VCT phase to the target VCT phase.

As a result, the lock pin 58 becomes acted on by a lateral force tending to press it against a side face of the lock pin accommodation chamber 57. At the end of the opposite-direction drive control interval T3 (at time point t10), F/B control is commenced for driving the actual VCT phase towards the target VCT phase (although the actual VCT phase cannot yet actually change). The control duty ratio thus becomes set within the range of the advancement mode A.

The lock pin 58 thereby becomes moved in the phase-advancement direction of the rotor 35, i.e., towards the laterally opposite side of the lock pin accommodation chamber 57. In the advancement mode A, the oil supply passage of the lock control chamber 61 remains open, so that the lock pin 58 continues to be driven by oil pressure towards the retracted (lock release) position.

The momentary application of reverse-direction drive control during the interval T3 ensures that (even if the lock pin 58 does not become withdrawn from the lock hole 59 during the interval T3) there is a short interval following time point t10 in which the lock pin 58 is not in contact with a side wall of the lock pin accommodation chamber 57. This reliably ensures that the lock pin 58 can be driven to the retracted position, to achieve unlocking of the VCT phase.

In this example it is assumed that the post-release target VCT phase is advanced with respect to the intermediate lock phase. If the post-release target VCT phase following lock release is to be retarded with respect to the intermediate lock phase, then the rotor 35 (hence the lock pin 58) will be driven in the phase-advancement direction during the interval T3, and the retardation mode R will then be entered. FIB control applied following the time point t10 will then act to drive the lock pin 58 in the phase-retardation direction, and the same effect as described above will be obtained.

It can thus be understood that with this embodiment, when a transition from the locked condition to the unlocked (lock release) condition is executed, the lock pin 58 is first momentarily acted on by a laterally-directed force (produced by a pressure difference between the advancement chamber 42 and retardation chamber 43) oriented in a first direction, while oil pressure is acting to drive the lock pin 58 to the lock release position, then (following time point t10) the lock pin 58 is acted on by a laterally-directed force in the opposite direction (i.e., the direction for shifting the actual VCT phase towards the target VCT phase), while still being driven (i.e., by an axially-directed force) towards the lock release position. The lock pin 58 can thereby be reliably disengaged from the lock hole 59.

Variation of the actual VCT phase commences after lock release has been achieved. Since the post-release target VCT phase is substantially different from the intermediate lock phase, there is a large change in the actual VCT phase when lock release occurs. Hence, the point at which lock release has been completed can be rapidly and accurately judged. This enables the engine ECU 21 to effect a rapid transition from the locked condition to commencement of FIB control of the actual VCT phase.

The duration of the interval T3 may be fixedly predetermined as an estimated amount of time required to complete the lock release operation. However, that amount of time varies in accordance with the oil viscosity and is delivery pressure.

For example if the opposite-direction drive control interval T3 is excessively long, the tip of the lock pin 58 may become excessively strongly pressed against a side face of the lock hole 59. It may thereby become difficult to withdraw the lock pin 58 from the lock hole 59, causing failure of lock release.

Conversely if the interval T3 is excessively short, then the oil pressure within the lock control chamber 61 may not have increased sufficiently (by the end of the interval T3) for the lock pin 58 to have been momentarily actuated by the reverse-direction drive control. In that case, after changeover to normal F/B control begins following the end of the interval T3, lock pin 58 may become strongly pressed against a side face of the lock pin accommodation chamber 57 or the lock hole 59 before the lock pin 58 can be withdrawn from the lock hole 59. Hence, unlocking of the VCT phase may fail.

For that reason, the currently appropriate value of the interval T3 is preferably adjusted in accordance with at least one of the following parameters: engine coolant temperature, oil temperature, engine speed.

It is possible that when a lock release operation is initiated, the lock pin 58 may become disengaged from the lock hole 59 before the end of the duration predetermined for the opposite-direction drive control interval T3. Hence, the apparatus may be further configured such that if the actual VCT phase commences to vary by more than a predetermined amount during the interval T3, the engine ECU 21 judges that lock release has been achieved, whereupon the interval T3 is immediately terminated and FIB control is commenced in accordance with the target VCT phase.

Processing routines which are executed by the engine ECU 21 to perform the above operations will be described in the following.

Lock Control Routine

Figure 9:
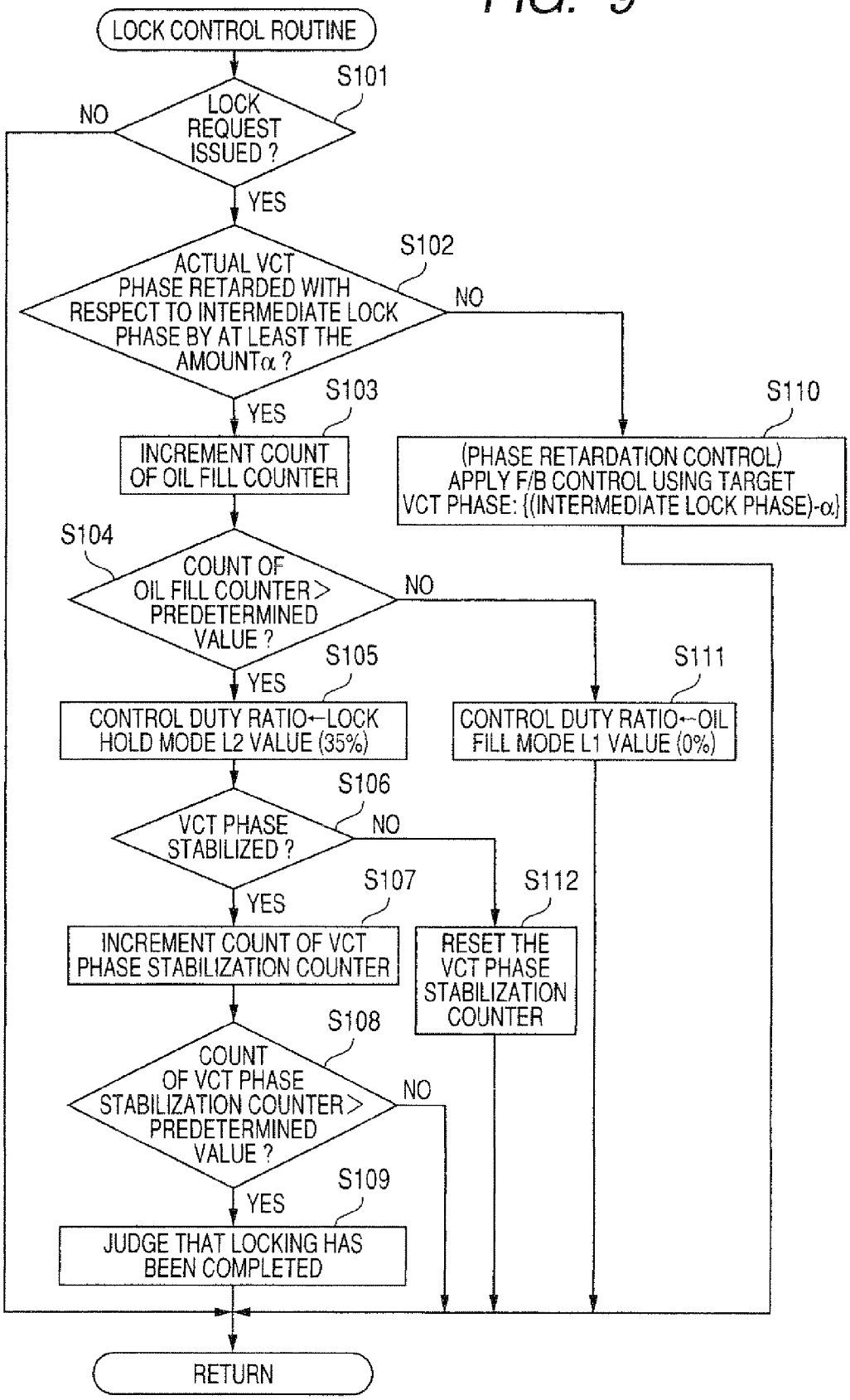
FIG. 9 is a flow diagram of a lock control routine that is executed by an engine control circuit of the embodiment.

The lock control routine shown in the flow diagram of FIG. 9 is repetitively executed by the engine ECU 21 with a fixed period while the engine 11 is running. The function implemented by the engine ECU 21 in executing this routine corresponds to lock control circuitry as recited in the appended claims.

Firstly (step S101) a decision is made as to whether a lock request is being issued. If that is not the case, this execution of the lock control routine is ended.

If it is found that a lock request is being issued, a decision is made (step S102) as to whether the actual VCT phase is retarded with respect to the intermediate lock phase by more than a predetermined amount a. This judgement step is performed for determining whether the actual VCT phase is appropriate for commencing an operation to enter the locked condition, as described above referring to FIG. 6A.

If it is found that the actual VCT phase is not retarded with respect to the intermediate lock phase by more than $\alpha$, step S110 is then executed in which the target VCT phase is set as a value {(intermediate lock phase)$-\alpha$}, i.e., phase-retarded with respect to the intermediate lock phase by the amount a. This execution of the lock control routine is then ended. Thereafter, F/B control is applied for bringing the actual VCT phase to a condition of being retarded with respect to the intermediate lock phase by the predetermined amount $\alpha$.

When it is judged in step S102 that this condition has been reached, i.e., the actual VCT phase is suitable for applying lock control, step S103 is executed in which the count of an oil fill counter is incremented. This count serves to measure the duration of operation in the lock mode L1 (oil fill mode).

Step S104 is then executed to judge whether the oil fill counter has reached a predetermined count value (corresponding to the interval from t1 to t2 in FIG. 6C described above). If that has not yet been reached, the control duty ratio of the hydraulic control valve 25 is set to a value (e.g., 0%) within the range of the lock mode L1 (step S111). Operation is thereafter performed in the lock mode L1 (oil fill mode), to replenish the oil in the advancement chamber 42 and retardation chamber 43 as described hereinabove. This execution of the lock control routine is then ended. Operation in the lock mode L1 is thereafter continued, as the lock control routine is successively executed, until the oil fill counter has reached the predetermined count.

When it is judged in step S104 (YES decision) that the oil fill counter has reached the predetermined count (time point t2 in FIG. 60) step S105 is then executed in which the control duty ratio is set to a value (e.g., 35%) that is within the range of the lock mode L2 (lock hold mode). If a stable locked condition has not yet been reached (i.e., the lock pin 58 is not yet engaged within the lock hole 59) the actual VCT phase becomes gradually advanced due to the torque applied by the camshaft spring 55, and also varies due to varying amounts of load torque of the intake camshaft 16. As described hereinabove, when the locked condition is reached, the actual VCT phase becomes fixed close to the intermediate lock phase.

Following step S105, a decision is made (step S106) as to whether the actual VCT phase has become stabilized close to the intermediate lock phase. Specifically, a decision is made as to whether an amount of variation in the actual VCT phase per unit time interval exceeds a predetermined amount. This judgement can be made based upon extents of variation in the actual VCT phase between successive executions of the lock control routine. If the actual VCT phase is judged to be stable up to this point (YES decision in step S106), a counter (VCT phase stabilization counter) is incremented (step S107), and step S108 is then executed. If there is a NO decision in step S106, the VCT phase stabilization counter is reset (step S112) and this execution of the lock control routine is ended.

In step S108, a decision is made as to whether the VCT phase stabilization counter has attained a predetermined count (e.g., at time point t4 in FIG. 6C above). If so (YES decision), then it is judged that the locked condition has been reached (step S109).

When it is determined in step S109 that locking has been completed, the process (executed by the engine ECU 21, but unrelated to the present invention) which issues the lock command is notified, and thus ceases to issue is the lock command.

For further confirmation that the locked condition has been reached, a YES decision in step S108 above may be made dependent on a combination of two decisions:

(1) whether the actual VCT phase is sufficiently close to the intermediate lock phase (i.e., whether the difference between the actual VCT phase and the intermediate lock phase is less than a predetermined value) while also (2) whether the actual VCT phase has remained stable during a sufficient length of time following the oil fill interval (i.e., whether the VCT phase stabilization counter has reached the predetermined count value).

Intermittent Oil Fill Routine

Figure 10:
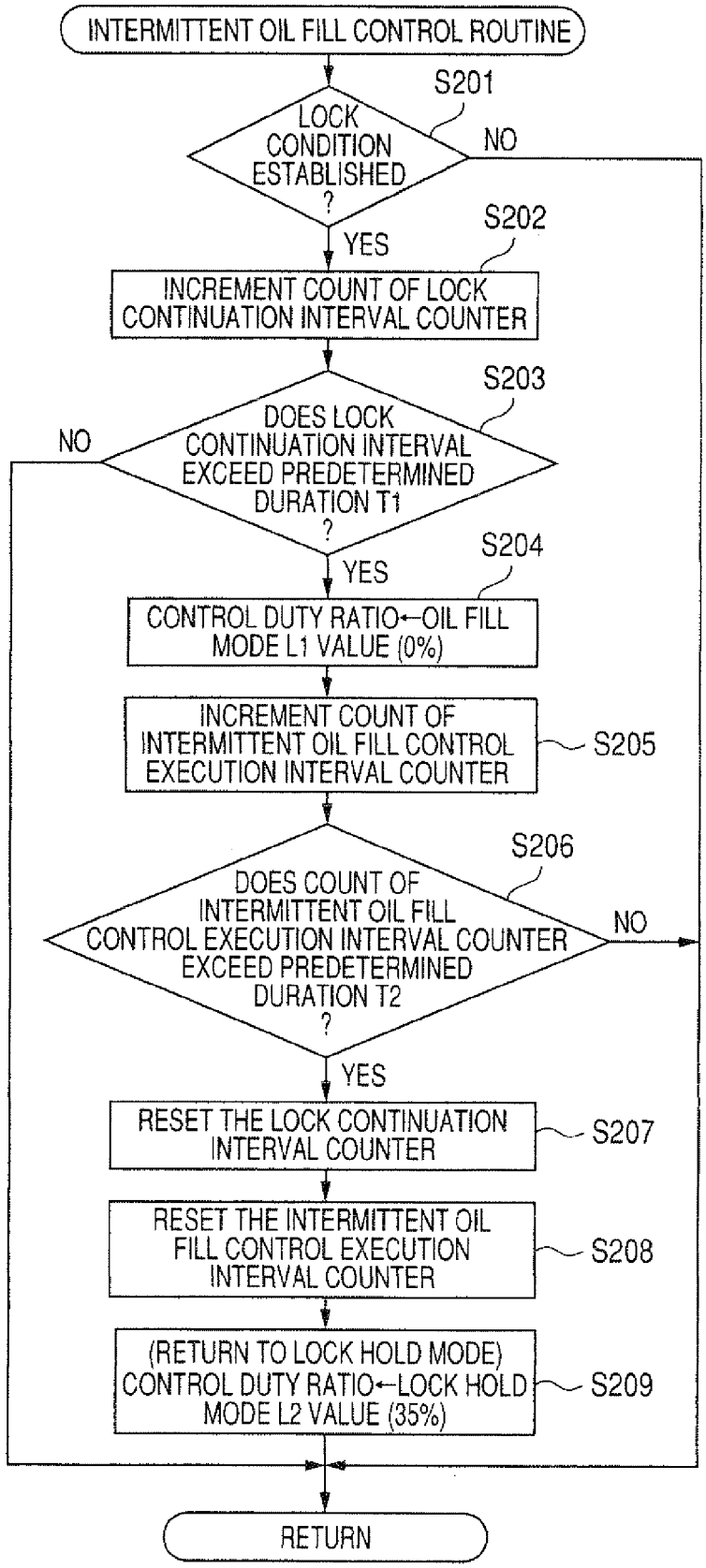
FIG. 10 is a flow diagram of an intermittent oil filling control routine that is executed by the engine control circuit of the embodiment.

FIG. 10 is a flow diagram of an intermittent oil filling routine, which is repetitively executed by the engine ECU 21 at fixed intervals during the locked condition of the variable valve timing apparatus 18 while the engine 11 is idling.

Firstly in step S201 a decision is made as to whether the lock condition is established. If there is a NO decision (the variable valve timing apparatus 18 is in the lock release condition) this execution of the intermittent oil fill routine is ended. If it is judged that the lock condition is established, a counter (lock continuation counter) is incremented (step S202). Step S203 is then executed, to judge whether the count of the lock continuation counter exceeds a value that corresponds to a predetermined elapsed-time interval, i.e., an interval T1 (illustrated in the example of FIG. 7C above) during which the locked condition has been maintained. If it is judged that the interval T1 has not been exceeded, this execution of the routine is ended.

The duration of the interval T1 could be fixedly predetermined, as the estimated length of time by which the amount of oil leakage from the advancement chamber 42 and retardation chamber 43 will exceed a predetermined maximum allowable amount. However the value of T1 is preferably adjusted in accordance with at least one of a set of parameter values as described hereinabove, i.e., the oil temperature, the engine coolant temperature, and the engine speed.

If it is judged in step S203 that the interval T1 has been exceeded, the control duty ratio is then set (step S204) within the range of the lock mode L1 (oil fill mode), e.g., 0%. Next in step S205, the count of the intermittent oil fill control execution interval counter is incremented. A decision is then made (step S206) as to whether the intermittent oil fill control execution duration counter exceeds a count corresponding to the above-described interval T2 (shown in FIG. 70 above). If there is a NO decision, this execution of the intermittent oil fill control routine is ended.

The duration of the interval T2 is predetermined as the estimated amount of time required to replenish an (anticipated maximum) amount of oil leakage that would be lost from the advancement chamber 42 and retardation chamber 43 during the interval T1 between successive oil fill intervals T2.

The duration of the interval T2 may be fixedly predetermined. However, for the same reasons as described above for the interval T1, a currently appropriate value of T2 is preferably determined in accordance with values at least one of a specific set of parameters, i.e., oil temperature, engine coolant temperature, and engine speed. The engine ECU 21 can for example perform this by using a memory map which relates values of T2 to values of such a parameter, or by calculation using the parameter value(s) in a predetermined equation.

If it is judged in step S206 that the duration of oil filling control exceeds the predetermined interval T2, the lock continuation counter is reset (step S207). Next in step S208, the intermittent oil fill control execution duration counter is also reset. Step S209 is then executed, in which the control duty ratio of the to hydraulic control valve 25 is returned to a value within the range of the lock mode L2 (lock hold mode) as shown in FIG. 7B, e.g., is changed to 35%.

Lock Release Control Routine

Figure 11:
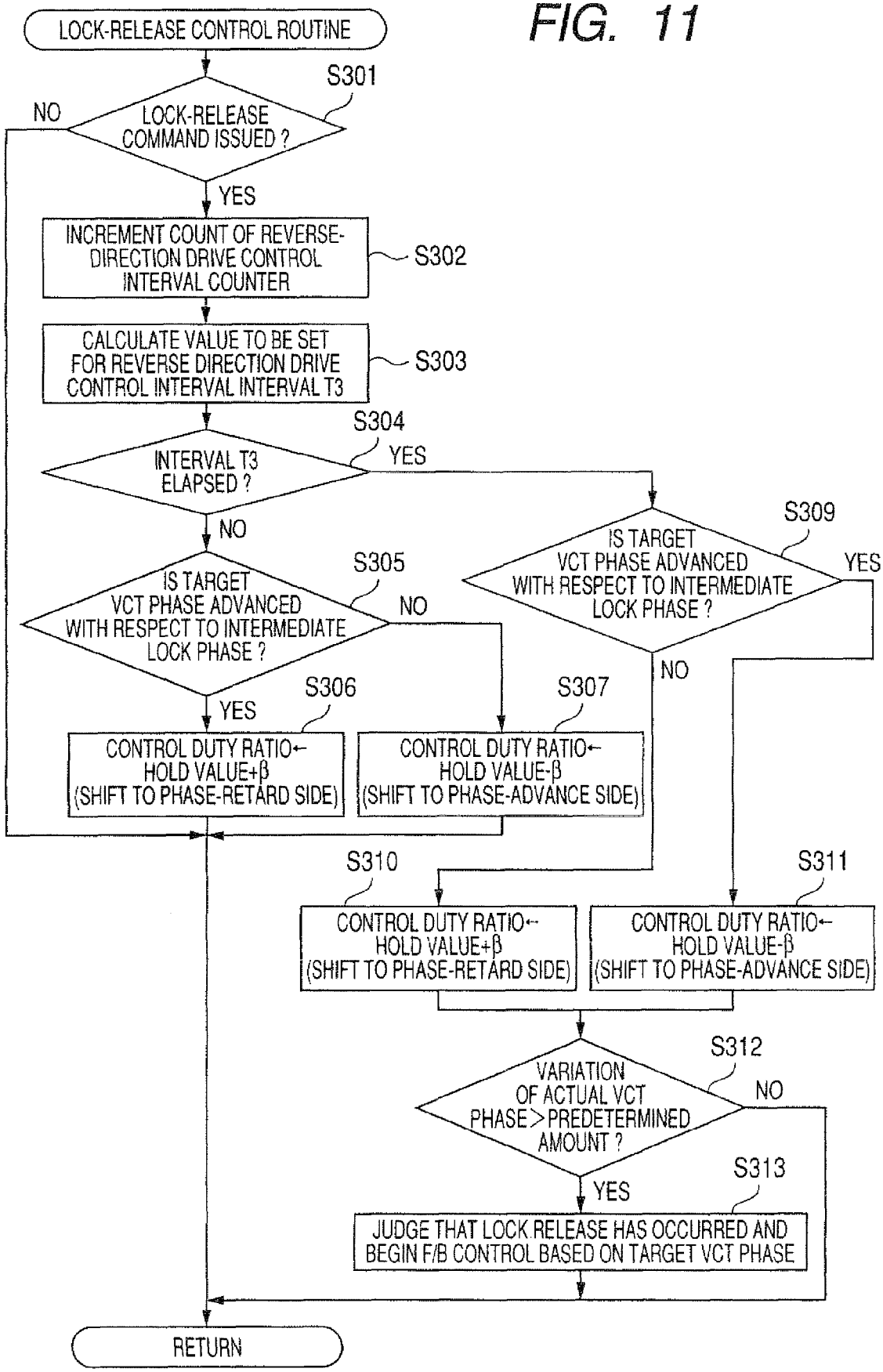
FIG. 11 is a flow diagram of a lock release control routine that is executed by the engine control circuit of the embodiment.

FIG. 11 is a flow diagram of a lock release control routine, which is repetitively executed at fixed intervals by the engine ECU 21 while the engine 11 is idling with the variable valve timing apparatus 18 in the locked condition.

In executing this lock release control routine, the hydraulic control valve 25 implements the function of lock release control circuitry as set out in the appended claims.

Firstly in step S301, a decision is made as to whether a lock release command is being issued (where "issuing of a command" has the significance described hereinabove referring to step S101 of FIG. 9). If such a command is not currently being issued, then this execution of the lock release control routine is ended.

If a lock release command is being issued, a counter (reverse-direction drive control interval counter) is incremented (step S302).

Next in step S303, the value to be set for the reverse-direction drive control interval T3 is calculated. This may be fixed, as a predetermined maximum amount of time that is expected to be necessary for completing a lock release operation. However T3 is preferably set as a currently appropriate value based on one or more parameters (oil temperature, engine coolant temperature, or engine speed) which affect the viscosity or the delivery pressure of the oil, by being calculated using an appropriate equation, or by being read out from a memory map which relates values of T3 to corresponding values of such a parameter. Although not specifically indicated in FIG. 11, step S303 is executed only at the first execution of the lock-release control routine after a lock release command begins to be issued, and is skipped in each of subsequent executions of the routine.

Step S304 is then executed to judge whether the reverse-direction drive control interval T3 has elapsed. If the interval has not yet elapsed, step S305 is then executed, while otherwise (NO decision), Step S308 is then executed.

In step S305, a decision is made as to whether the target VCT phase is advanced with respect to the intermediate lock phase. If so, step S306 is then executed, while if the target VCT phase is not judged to be advanced with respect to the intermediate lock phase, step S307 is then executed. This execution of the routine is then ended.

In step S306, the control duty ratio is set as {(hold value)+ β}, where β is a predetermined fixed value and the hold value is as defined hereinabove (indicated as the center value in the hold range H in FIG. 5). The control duty ratio is thereby set appropriately within the range of the retardation mode R. Oil is thereby supplied to the retardation chamber 43, causing a torque to act on the rotor 35 (and hence on the lock pin 58) during the interval T3 acting in the phase-retardation direction, i.e., the opposite direction to the direction for moving towards the target VCT phase. Following step S306, this execution of the routine is ended.

In step S307, the control duty ratio is set as {(hold value)− β}. The control duty ratio becomes thereby shifted to a suitable value within the range of the advancement mode A. Oil is thereby supplied to the advancement chamber 42, causing a torque to act on the rotor 35 in the phase-advance direction (opposite direction to that for moving towards the target VCT phase) during the interval T3. This execution of the routine is then ended.

If there is a NO decision in step S304 so that Step S308 is executed, F/B control of the VCT phase is performed in accordance with the target VCT phase (S308). As illustrated in FIG. 8A above, the actual VCT phase will begin to vary after lock release has occurred. Hence following step S308, a decision is made in step S309 as to whether the actual VCT phase varies by more than a predetermined amount. If so, it is judged (step S310) that lock release has occurred, and further execution of this routine is ended (i.e., the process which originated the lock release command is notified that lock release has occurred). If there is a NO decision in step S309, then this execution of the lock-release to control routine is ended, with step 308 being repeated in subsequent executions of the routine until a YES decision is reached in step S309.

It will be understood that various modifications to the above-described lock-release control processing could be envisaged. For example the embodiment could be configured such that when lock release is not detected after a predetermined time limit has elapsed following the time interval T3, the lock-release control processing is recommenced.

With the preferred embodiment as described above, when a lock command is issued, the actual VCT phase is first set to a condition of being appropriately retarded with respect to the intermediate lock phase, and the lock pin 58 is urged towards a protruding position by the lock spring 62 (in lock mode L1), to an extent that communication is enabled between the advancement chamber 42 and the retardation chamber 43, enabling oil to pass between these chambers. In that condition, oil is supplied to the advancement chamber 42, so that both the advancement chamber 42 and the retardation chamber 43 become filled with oil, while a resultant pressure difference arises between the advancement chamber 42 and retardation chamber 43. This pressure difference, in conjunction with a torque applied to the intake camshaft 16 by the camshaft spring 55, acts to advance the actual VCT phase. After a predetermined interval in this condition has elapsed, the supplying of oil to the advancement chamber 42 is interrupted (or restricted to a small flow). The actual VCT phase continues to be advanced by the torque applied by the camshaft spring 55, towards the intermediate lock phase, until the lock pin 58 can engage in the lock hole 59. When it is detected that the actual VCT phase has thereby become stabilized close to the intermediate lock phase, i.e., that variations of the actual VCT phase are smaller than a predetermined extent, the engine ECU 21 judges that locking has been completed.

In that way, completion of locking can be easily and reliably judged, so that problems due to erroneous judgement that locking has been completed can be prevented.

In addition, while the locked condition continues during idling of the engine 11, intermittent oil filling control is executed in which the intermittent oil fill mode L1 is periodically applied during a short interval, to replenish the oil in the advancement chamber 42 and the retardation chamber 43. Thus even if there is significant leakage of oil from the advancement chamber 42 and retardation chamber 43 during operation in the locked condition, it is ensured that these chambers will be maintained in a filled condition.

This serves to prevent lowering of the oil pressure within the advancement chamber 42 and retardation chamber 43 due to leakage, thereby ensuring that a smooth and rapid transition can be made from the locked condition of the actual VCT phase when the engine is accelerated after having been idling.

However since this oil filling operation is executed only during periodically repeated short intervals while the locked condition continues, it can be ensured that sufficient oil pressure is maintained for driving other hydraulic equipment of the vehicle. Adverse effects upon the operation of such other hydraulic equipment can thus be prevented.

Furthermore, when a lock release command is issued, the engine ECU 21 determines a target VCT phase that is to be applied in F/B control when the locked condition has been released. The control duty ratio is then set within the range of a control mode (the advancement mode A or the retardation mode R) whereby torque is applied to the rotor 35 in a direction which is the opposite of the direction required for driving the actual VCT phase to the predetermined target VCT phase. The lock pin 58 accordingly becomes pressed against a side face of the lock pin accommodation chamber 57, while at the same time (since operation is in the advancement mode A or the retardation mode R) oil is being supplied to the lock control chamber 61, thereby producing pressure acting to move the lock pin 58 to the retracted position (disengaged from the lock hole 59). This condition is continued for a short predetermined interval (T3). Following the end of that interval, FIB control is applied in accordance with the to predetermined target VCT phase, causing the lock pin 58 to be moved laterally towards an opposite side face of the lock pin accommodation chamber 57. Hence, the lock pin 58 can be readily disengaged from the lock hole 59. When this disengaged condition is detected (as a variation of the actual VCT phase), it is judged that lock release has been completed. FIB control is thereafter executed in accordance with the target VCT phase.

This form of lock release control ensures that the lock pin 58 can be reliably disengaged from the lock hole 59, while also ensuring that completion of lock release can be reliably confirmed, thereby enabling rapid changeover from the locked condition to feedback control of the actual VCT phase.

Although the above embodiment has been described with respect to variable valve timing control of the intake valves of an engine, it will be understood that the invention is equally applicable to variable valve timing control of the exhaust valves of an engine. In that case, the relationship between the control directions of the VCT phase (phase advancement direction and phase retardation) may be made the opposite to that for the case of variable valve timing control of the intake valves.

Furthermore various modifications or alternative configurations of the above embodiment may be envisaged, which fall within the scope claimed for the invention in the appended claims.

What is claimed is:

1. A variable valve timing control apparatus comprising:

a hydraulic type of variable valve timing apparatus operable for adjusting a valve timing of an internal combustion engine by adjusting a variable cam timing phase (abbreviated herein to VCT phase) of a camshaft of said engine, and comprising a lock pin movable between a fully protruding position whereby said VCT phase is held in a locked condition at an intermediate lock phase that is within a range of adjustment of said VCT phase and a retracted position whereby said VCT phase is released from said locked condition, an oil pressure control apparatus controllable for varying a difference between respective oil pressures within an advancement chamber and to a retardation chamber of said variable valve timing apparatus, for selectively advancing and retarding said VCT phase, and controllable for varying an oil pressure within a lock control chamber of said variable valve timing apparatus, for selectively urging said lock pin towards said retracted position and towards said fully protruding position, and wherein said variable valve timing apparatus is configured for establishing communication between said advancement chamber and said retardation chamber, enabling oil to pass between said advancement chamber and retardation chamber, when said lock pin is displaced from said retracted position towards said fully protruding position by at least a predetermined amount, and for isolating said advancement chamber from said retardation chamber when said lock pin is set at said retracted position, and said variable valve timing control apparatus comprises lock control circuitry configured to be responsive to a locking command for:

during an oil fill interval of predetermined duration, controlling said oil pressure control apparatus to supply oil to a predetermined one if said advancement chamber and said retardation chamber for thereby adjusting said VCT phase to successively reduce a difference between said VCT phase and said intermediate lock phase, while controlling said oil pressure control apparatus to displace said lock pin from said retracted position and urge said lock pin towards said fully protruding position, to thereby establish communication between said retardation chamber and said advancement chamber;

immediately subsequent to said oil fill interval, controlling said oil pressure control apparatus to establish a lock hold state in which supplying of oil to each of said advancement chamber and said retardation chamber is terminated or substantially restricted, while urging said lock pin towards said fully protruding position; and measuring a duration of said lock hold state, and judging that said locked condition has been attained when said duration attains a predetermined value.

2. A variable valve timing control apparatus according to claim 1, wherein said locking control circuitry is configured to detect a rate of variation of said VCT phase with respect to time, said variation of VCT phase resulting from periodic variations of torque applied by said camshaft in operating valves of said engine, detect a VCT phase stabilization state, occurring during said lock hold state following said oil fill interval, whereby said rate of variation of said VCT phase has become less than a predetermined amount, and to measure said duration of the lock hold state only when said VCT phase stabilization state is detected.

3. A variable valve timing control apparatus according to claim 1, comprising a spring disposed to apply a torque to said camshaft acting to drive said VCT phase in a direction that is opposite to a direction of action of a load torque of said camshaft;

wherein when a locking command is issued while said VCT phase is beyond said intermediate lock phase, as measured along said direction of action of said spring, said lock control circuitry controls said oil pressure control apparatus to drive said VCT phase in said direction of action of said load torque, passing through said intermediate lock phase, and to then initiate said oil fill interval.

4. A variable valve timing control apparatus according to claim 1, wherein said camshaft is subjected to a load torque acting in a retardation direction of said VCT phase, and wherein during said oil fill interval, said lock control circuitry controls said oil pressure control apparatus to supply oil to said advancement chamber.

5. A variable valve timing control apparatus according to claim 1, wherein said oil pressure control apparatus comprises a single hydraulic control valve, wherein said hydraulic control valve is configured to perform:

a phase control function of selectively supplying oil via a selected one of a port corresponding to said advancement chamber and a port corresponding to said retardation chamber while draining oil from the other one of said ports, for adjusting said VCT phase, while said VCT phase is released from said locked condition; and a lock control function of selectively urging said lock pin towards said retracted position and said protruding position by oil pressure control.

6. A variable valve timing control apparatus according to claim 5, wherein said oil pressure control apparatus is configured to be operable in a plurality of operating modes, said operating modes corresponding to respectively different control regions within a variation range of a control quantity of said hydraulic control valve, and said plurality of operating modes comprise:

a retardation mode wherein said VCT phase is driven in a retardation direction, a hold mode wherein said VCT phase is held substantially constant, an advancement mode wherein said VCT phase is driven in an advancement direction, and a lock mode wherein said lock pin is urged towards said protruding position, with communication established between said advancement chamber and said retardation chamber;

wherein said lock mode comprises a lock hold mode and an oil fill mode, corresponding to respectively different ones of said control regions, wherein during operation in said lock hold mode said advancement chamber and said retardation chamber are held in an isolated condition and wherein during operation in said oil fill mode, oil is supplied to a predetermined one of said advancement chamber and said retardation chamber.

7. A variable valve timing control apparatus according to claim 6, comprising an actuator controlled by said lock control circuitry through application of variable-width drive pulses, wherein said hydraulic control valve comprises a spool valve having a plurality of output ports and a spool coupled to be displaced by said actuator, said output ports being respectively connected to said advancement chamber, said retardation chamber and said lock control chamber, and said control quantity of said hydraulic control valve comprises a duty ratio of said drive pulses.

8. A variable valve timing control apparatus comprising:

a hydraulic type of variable valve timing apparatus controllable for adjusting a valve timing of an internal combustion engine by adjusting a VCT phase of a camshaft of said engine with respect to a crankshaft of said engine, and comprising a lock pin movable between a protruding position whereby said VCT phase is locked at an intermediate lock phase located within an adjustment range of said VCT phase and a retracted position whereby said VCT phase is released from said locked condition, an oil pressure control apparatus controllable for selectively supplying oil to an advancement chamber of said variable valve timing apparatus for advancing said VCT phase and to a retardation chamber of said variable valve timing apparatus for retarding said VCT phase, and controllable for supplying oil to a lock release chamber of said variable valve timing apparatus for driving said lock pin to said protruding position and for releasing said oil from said lock release chamber for driving said lock pin to said retracted position, locking control circuitry responsive to a locking command for controlling said oil pressure control apparatus to drive said lock pin to said protruding position, for locking said VCT phase at said intermediate lock phase, lock release control circuitry responsive to a lock release command for effecting a lock release operation by controlling said oil pressure control apparatus to drive said lock pin to said retracted position, and phase control circuitry configured to determine a post-release target value of VCT phase to be applied in feedback control of said VCT phase following completion of said lock release operation, and configured to execute said feedback control;

wherein said variable valve timing apparatus is configured for enabling communication between said retardation chamber and said advancement chamber and thereby enabling oil to pass between said retardation chamber and said advancement chamber, when said lock pin is displaced from said retracted position by more than a predetermined amount, and wherein when said lock release command is issued, during a predetermined reverse-direction drive interval, reverse-direction drive control is executed whereby said oil pressure control apparatus is controlled to urge said lock pin towards said protruding position while oil is selectively supplied to said advancement chamber and retardation chamber for driving said VCT phase in a direction that is opposite to a direction for changing from said intermediate lock phase to said post release target value of VCT phase, and feedback control of said VCT phase based on said post-release target value of VCT phase is initiated immediately following said reverse-direction drive interval, while said lock pin continues to be urged towards said protruding position.

9. A variable valve timing control apparatus according to claim 8, wherein said lock release circuitry is configured to set a duration of said reverse-direction drive control interval based upon a current value of at least one of a plurality of parameters including a coolant temperature of said engine, an oil temperature, and a rotation speed of said engine.

10. A variable valve timing control apparatus according to claim 8 wherein said lock release circuitry is configured to:

detect a condition, occurring subsequent to said reverse-direction drive control interval, whereby an amount of variation of said VCT phase becomes less than a predetermined amount, and judge that lock release has been achieved, when said condition is detected.

11. A variable valve timing control apparatus according to claim 10, wherein said lock release circuitry is configured to:

detect a condition, occurring during said reverse-direction drive control interval, whereby an amount of variation of said VCT phase becomes less than a predetermined amount; and when said condition is detected, immediately terminate said reverse-direction drive control, judge that lock release has been achieved, and initiate F/B control of said VCT phase based on said post-release VCT phase target value.

12. A variable valve timing control apparatus comprising a hydraulic type of variable valve timing apparatus controllable for adjusting a valve timing of an internal combustion engine by adjusting a variable cam timing phase (abbreviated herein to VCT phase) of a camshaft of said engine, and comprising a lock pin movable by oil pressure, within a lock release chamber, between a protruding position whereby said VCT phase is held in a locked condition and a retracted position whereby said VCT phase is released from said locked condition, an oil pressure control apparatus controllable for selectively supplying oil to an advancement chamber and to a retardation chamber of said variable valve timing apparatus, to respectively advance and retard said VCT phase, and for supplying oil to said lock release chamber, and locking control circuitry responsive to a locking command for controlling said oil pressure control apparatus to selectively set said lock pin to said retracted position and said protruding position;

wherein:

said variable valve timing apparatus is configured for enabling communication between said retardation chamber and said advancement chamber and thereby enabling oil to pass between said retardation chamber and said advancement chamber, when said lock pin becomes set at said protruding position, and said lock control circuitry is configured to control said oil pressure control apparatus for supplying oil to a predetermined one of said advancement chamber and said retardation chamber during each of periodically repeated oil fill intervals while said locked condition continues, for thereby maintaining each of said advancement chamber and said retardation chamber filled with oil during said locked condition.

13. A variable valve timing control apparatus according to claim 12, wherein said lock release circuitry is configured to set a repetition period of said oil fill intervals based upon a current value of at least one of a plurality of parameters including an engine coolant temperature, an oil temperature, and a rotation speed of said engine.

* * * * *